US009731324B2

(12) United States Patent
Pritzl

(10) Patent No.: US 9,731,324 B2
(45) Date of Patent: Aug. 15, 2017

(54) DRIVE FOR RAILROAD BALLAST TAMPER APPARATUS

(71) Applicant: Nordco Inc., Oak Creek, WI (US)

(72) Inventor: Patrick Pritzl, Franksville, WI (US)

(73) Assignee: NORDCO INC., Oak Creek, WI (US)

( * ) Notice: Subject to any disclaimer, the term of this patent is extended or adjusted under 35 U.S.C. 154(b) by 320 days.

(21) Appl. No.: 14/491,532

(22) Filed: Sep. 19, 2014

(65) Prior Publication Data

US 2015/0083014 A1 Mar. 26, 2015

Related U.S. Application Data

(60) Provisional application No. 61/882,089, filed on Sep. 25, 2013.

(51) Int. Cl.

*B06B 1/00* (2006.01)
*B06B 1/16* (2006.01)
*E01B 27/16* (2006.01)

(52) U.S. Cl.

CPC ..... *B06B 1/16* (2013.01); *E01B 27/16* (2013.01)

(58) Field of Classification Search

CPC . B06B 1/16; E01B 27/16; E01B 27/17; E01B 27/18
USPC ..... 104/10, 11, 12, 14
See application file for complete search history.

(56) References Cited

U.S. PATENT DOCUMENTS 1,621,103 A * 3/1927 Brumell ..... B25D 11/12 173/122
1,932,723 A * 10/1933 Brown ..... B25D 11/12 173/100
2,079,909 A * 5/1937 Jackson ..... H02K 7/06 104/13
2,201,023 A * 5/1940 Brown ..... E01B 27/14 104/13
2,821,935 A * 2/1958 Bean ..... E01B 27/16 104/12
3,856,426 A * 12/1974 Waschulewski ..... E02D 3/061 404/133.1
4,014,620 A * 3/1977 Vural ..... E02D 3/068 404/133.1

(Continued)

FOREIGN PATENT DOCUMENTS

CN 86107743 5/1988

OTHER PUBLICATIONS

Canadian Office Action from Canadian Patent Application No. 2,865,138, dated Jul. 15, 2016.

*Primary Examiner* — Jason C Smith

(74) *Attorney, Agent, or Firm* — Greer, Burns & Crain, Ltd.

(57) ABSTRACT

A tamper drive includes a wobble shaft rotatable about a central axis. The wobble shaft includes an eccentric hub recess within a movable bearing coupled to a yoke. The movable bearing rotates when the wobble shaft rotates to induce reciprocal movement of the yoke. In another tamper drive, an eccentric portion of a wobble shaft is rotatable within a bearing coupled to or integrated with an offset lobe having a pin slidingly disposed therein. Still another tamper drive includes an arm having a shaft fixedly coupled to one end, and first and second cam followers disposed at the other end. A rotatable cam provides a cam surface for each of the first and second cam followers.

20 Claims, 30 Drawing Sheets

(56) References Cited

U.S. PATENT DOCUMENTS

| | | | | | |
|---|---|---|---|---|---|
| 4,042,145 | A * | 8/1977 | Ehrlich | C12M 99/00 | 221/234 |
| 4,069,763 | A * | 1/1978 | Theurer | E01B 27/16 | 104/12 |
| 4,240,352 | A * | 12/1980 | Theurer | E01B 27/16 | 104/12 |
| 5,031,542 | A * | 7/1991 | Theurer | E01B 27/17 | 104/12 |
| 5,129,803 | A * | 7/1992 | Nomura | E01C 19/00 | 404/102 |
| 5,343,810 | A * | 9/1994 | Theurer | E01B 27/17 | 104/12 |
| 6,386,114 | B1 * | 5/2002 | Morgan | E01B 27/16 | 104/10 |
| 6,402,499 | B1 * | 6/2002 | Braungardt | B06B 1/16 | 310/323.18 |
| 6,978,718 | B2 * | 12/2005 | Seyrlehner | E01B 27/16 | 104/10 |
| 2015/0083014 | A1 * | 3/2015 | Pritzl | B06B 1/16 | 104/10 |

* cited by examiner

DRIVE FOR RAILROAD BALLAST TAMPER APPARATUS

RELATED APPLICATION

This application claims priority from U.S. Provisional Application Ser. No. 61/882,089, filed Sep. 25, 2013, under 35 U.S.C. §119, which is incorporated by reference herein.

BACKGROUND

The present invention relates generally to a ballast tamper machine for manipulating track ballast under railroad ties and correcting alignment of railroad tracks. Particular embodiments of the invention relate to a railroad right-of-way maintenance system providing a ballast tamping machine that reduces wear during pivoting.

Due to natural factors, such as floods, hurricanes, tornadoes, or seasonal ground shifting, as well as regular rail maintenance schedules, it is often necessary to correct the vertical and/or horizontal alignment of railroad tracks by manipulating the track ballast supporting railroad ties. This is commonly done using a method known as tamping. Conventional tamping machines include vibrating elongate, rigid tamping arms, also referred to as tamping tools. The tamping tools are forced into the ballast, on each side of the railroad tie, and vibrate at a given frequency within the ballast. Such vibration, in addition to movement of the tamper tool workhead causes movement of the ballast to support ties, and the corresponding track have a designated alignment, thereby leveling the railroad tracks.

In conventional tamper drives, a powered rotary shaft, usually a hydraulic motor, causes reciprocating rotary motion of at least one tamper tool. For example, a shaft pivots about an axis within a ring, causing a bearing to rotate within a housing. Such systems employ relatively complicated linkages having multiple components including bearings which add to manufacturing and operational costs when such components require replacement.

SUMMARY

A first tamper drive apparatus is provided, referred to herein as a spatial crank oscillation (SCO) tamper drive, which includes a wobble shaft rotatable about a central horizontal axis and disposed within a preferably constrained first bearing. An eccentric portion of the wobble shaft is fixedly coupled to an eccentric hub recess that is within a movable bearing. The axial rotation of the wobble shaft causes the eccentric hub recess to rotate within the movable bearing to induce rotation movement in the movable bearing itself. The movable bearing is coupled to a yoke, preferably such that the horizontal component of the rotation with respect to the yoke is constrained. This causes the yoke to reciprocate horizontally. A drive shaft is fixedly coupled to the yoke, and this drive shaft can be fixedly coupled to one or more tamper arms. The reciprocal horizontal movement of the yoke and the drive shaft results in vibration of the tamper arms.

Another tamper drive apparatus is provided, referred to herein as a sliding pin tamper drive, which includes a wobble shaft rotatable within a first bearing along a vertical central axis. The wobble shaft includes an eccentric portion that is rotatable within a second bearing coupled to or integrated with an offset lobe. Rotation of the eccentric portion of the wobble shaft causes the offset lobe to rotate. The offset lobe includes a slide portion through which a horizontal pin of a crank arm is disposed for reciprocal linear sliding movement. The slide and pin transmit a horizontal movement direction to the crank arm to reciprocally rotate an end of the crank arm about a second vertical axis. A drive shaft is fixedly coupled to the crank arm reciprocally rotating about the second vertical axis. One or more tamper arms preferably are fixedly coupled to the drive shaft for reciprocating movement.

In some example embodiments, the sliding pin tamper drive can further include a counterweight coupled to the wobble shaft. The counterweight preferably dampens or cancels vibration of the second bearing.

Yet another tamper drive is provided, which includes an arm. A vertically extending shaft is fixedly coupled to one end of the arm. The shaft rotates about a vertical axis. One or more tamper arms preferably are fixedly coupled to a lower end of the shaft. First and second laterally opposed cam followers are disposed at the other end of the arm. A rotatable cam provides a cam surface for each of the first and second vertical cam followers. Rotation of the cam causes a reciprocal rotation of the arm, and thus a reciprocal rotation of the shaft about the vertical axis.

In some example embodiments, the cam includes a rotatable driving arm including a barrel cam disposed thereon, and the first and second cam followers are disposed on a upper surface of the arm. In other example embodiments, the rotatable cam includes a globoidal cam driver, and the first and second cam followers are positioned horizontally with respect to the arm.

DETAILED DESCRIPTION

Figure 1A:
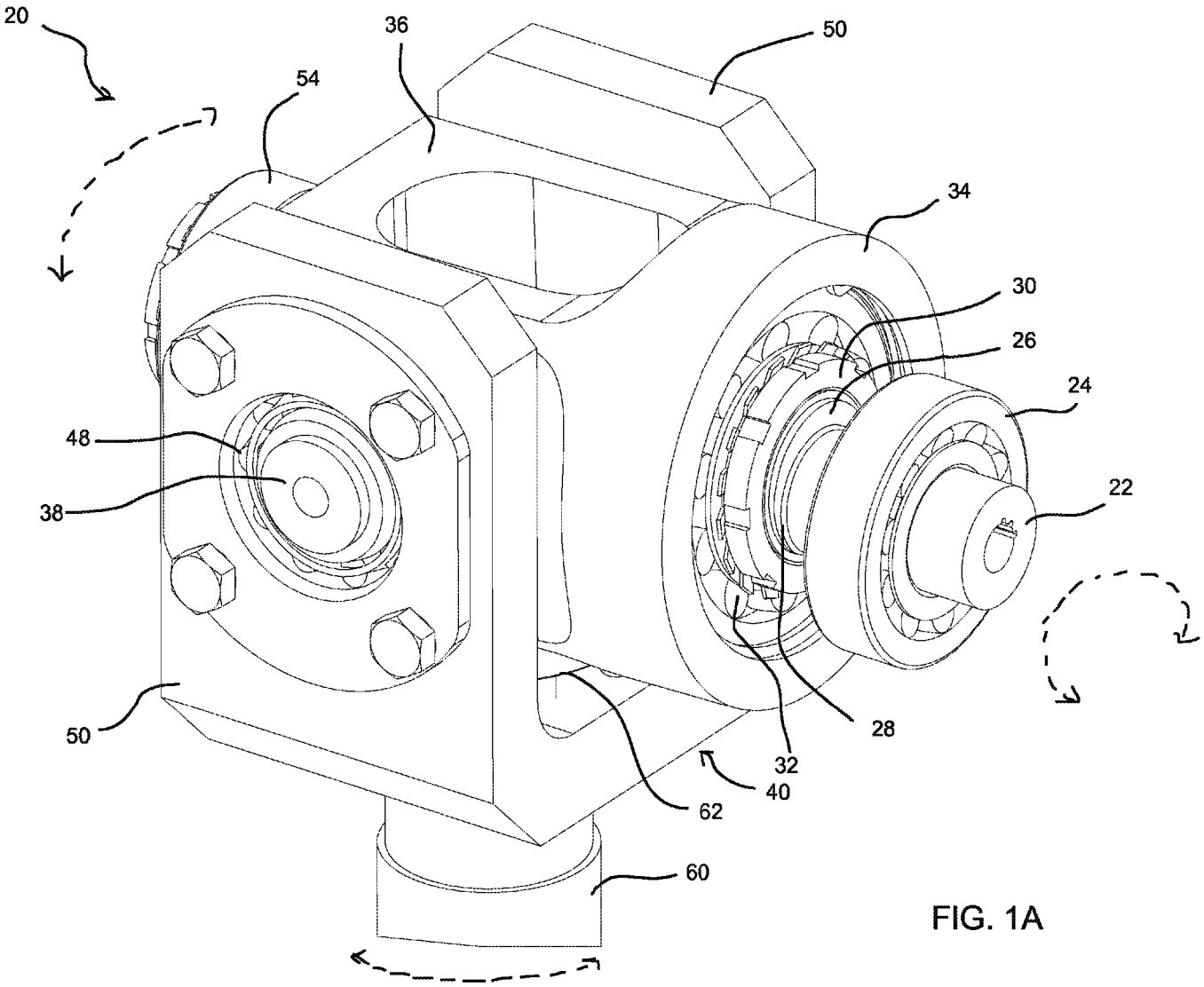
FIG. 1A is a perspective view of a portion of a spatial crank oscillation (SCO) tamper drive, at a first position.
Figure 1B:
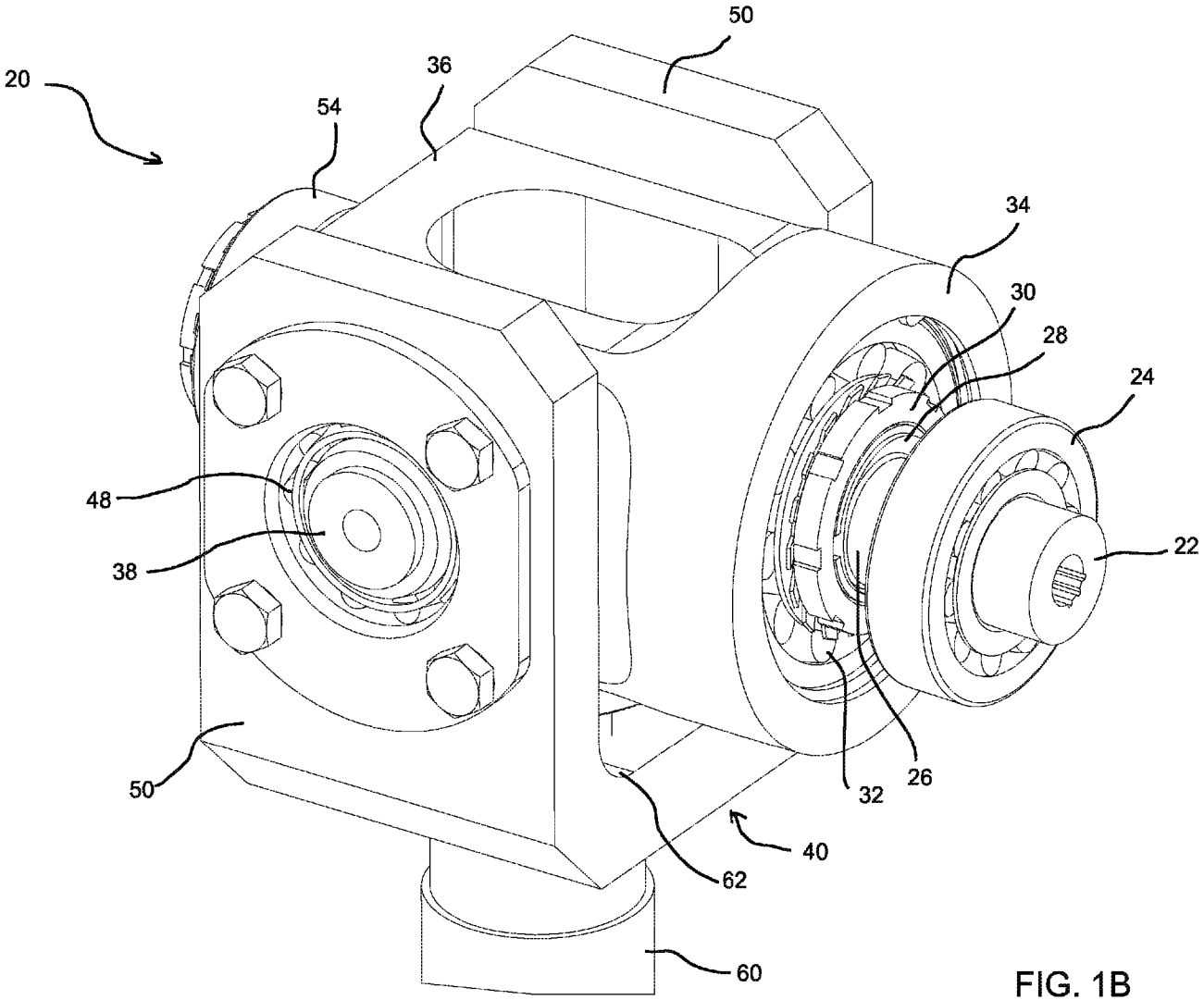
FIG. 1B is a perspective view of the SCO tamper drive in a second position.
Figure 1C:
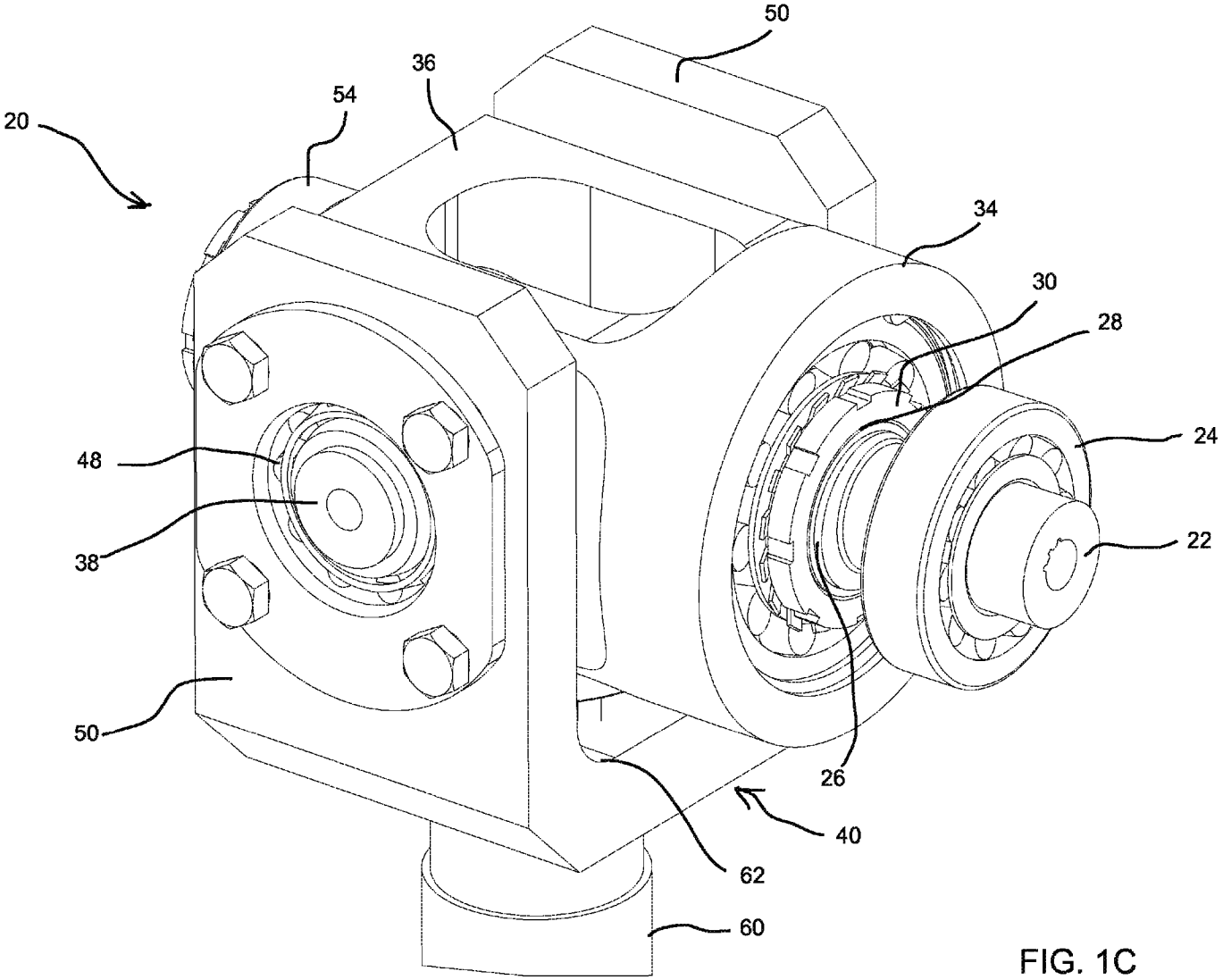
FIG. 1C is a perspective view of the SCO tamper drive in a third position.
Figure 1D:
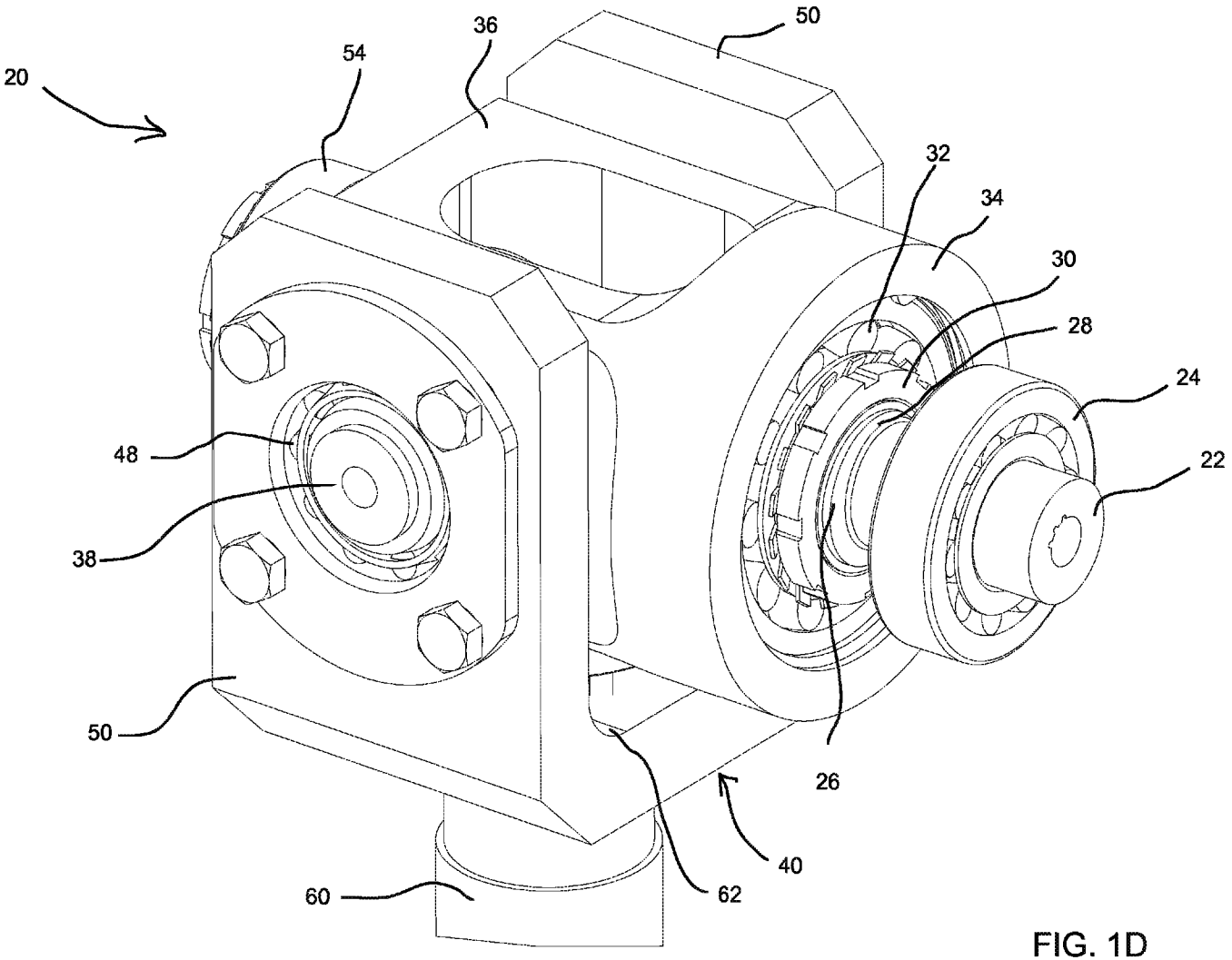
FIG. 1D is a perspective view of the SCO tamper drive in a fourth position.
Figure 1E:
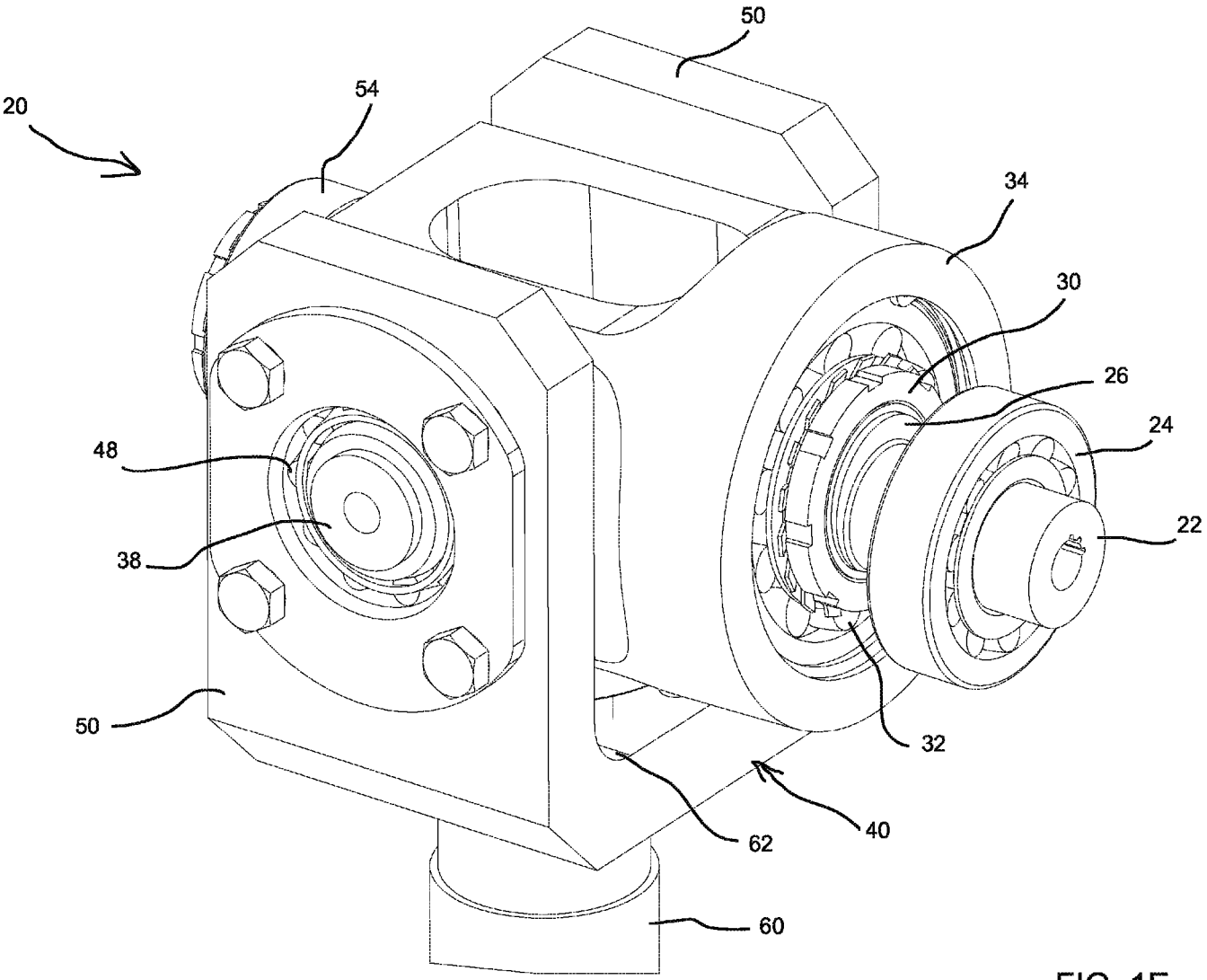
FIG. 1E is a perspective view of the SCO tamper drive in a fifth position.
Figure 2A:
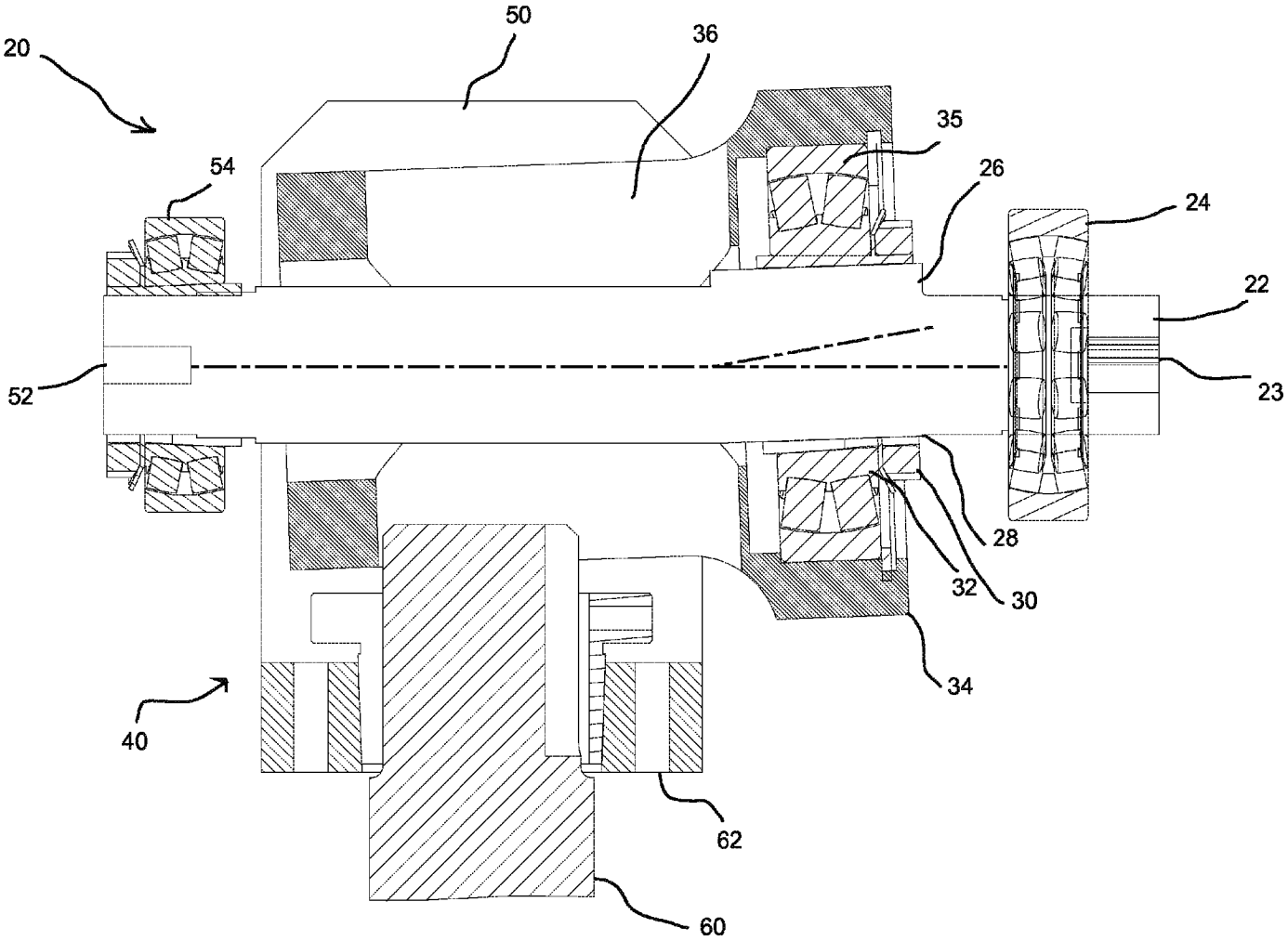
FIG. 2A is a sectional view of the SCO tamper drive in the first position.
Figure 2B:
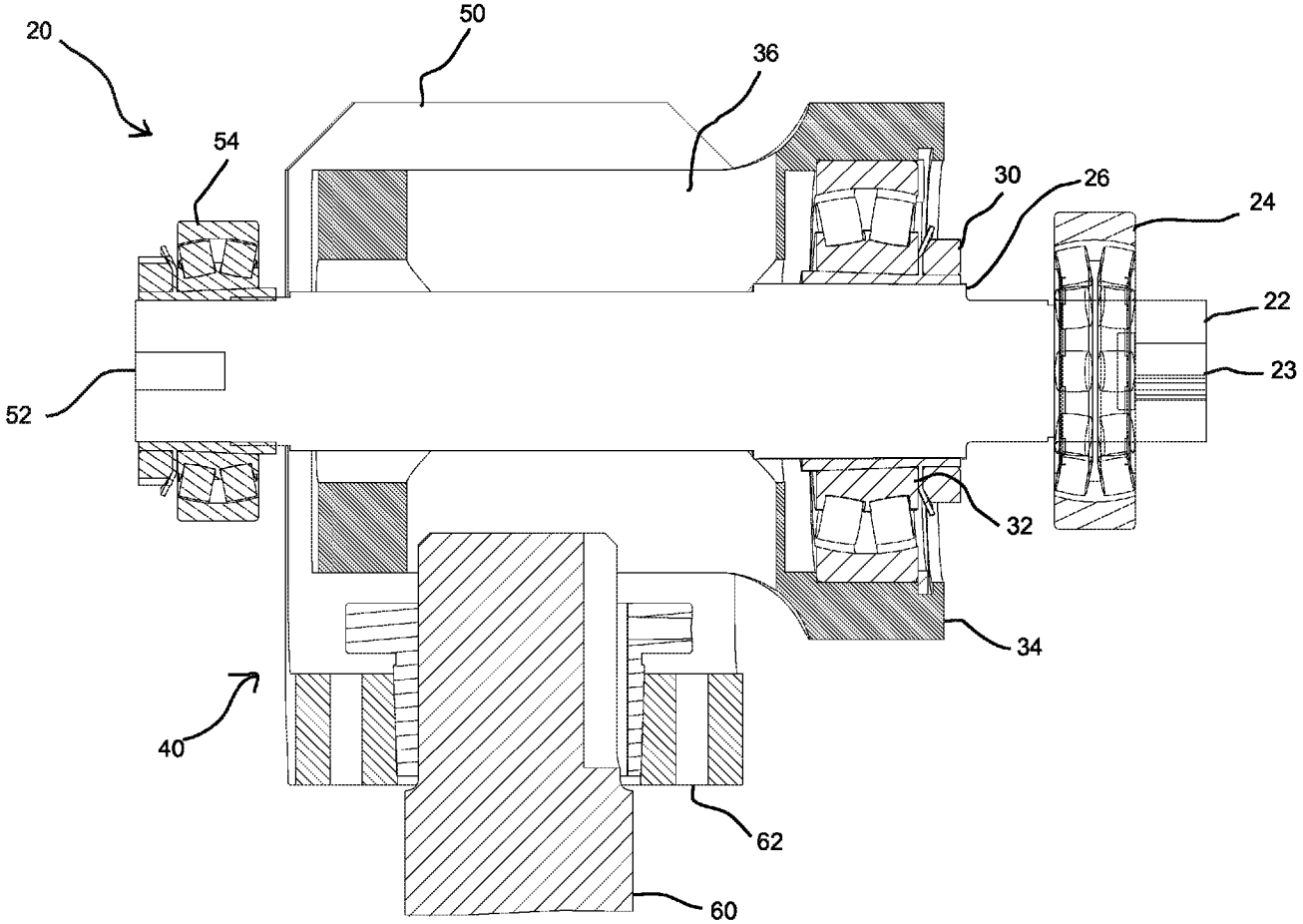
FIG. 2B is a sectional view of the SCO tamper drive in the second position.
Figure 2C:
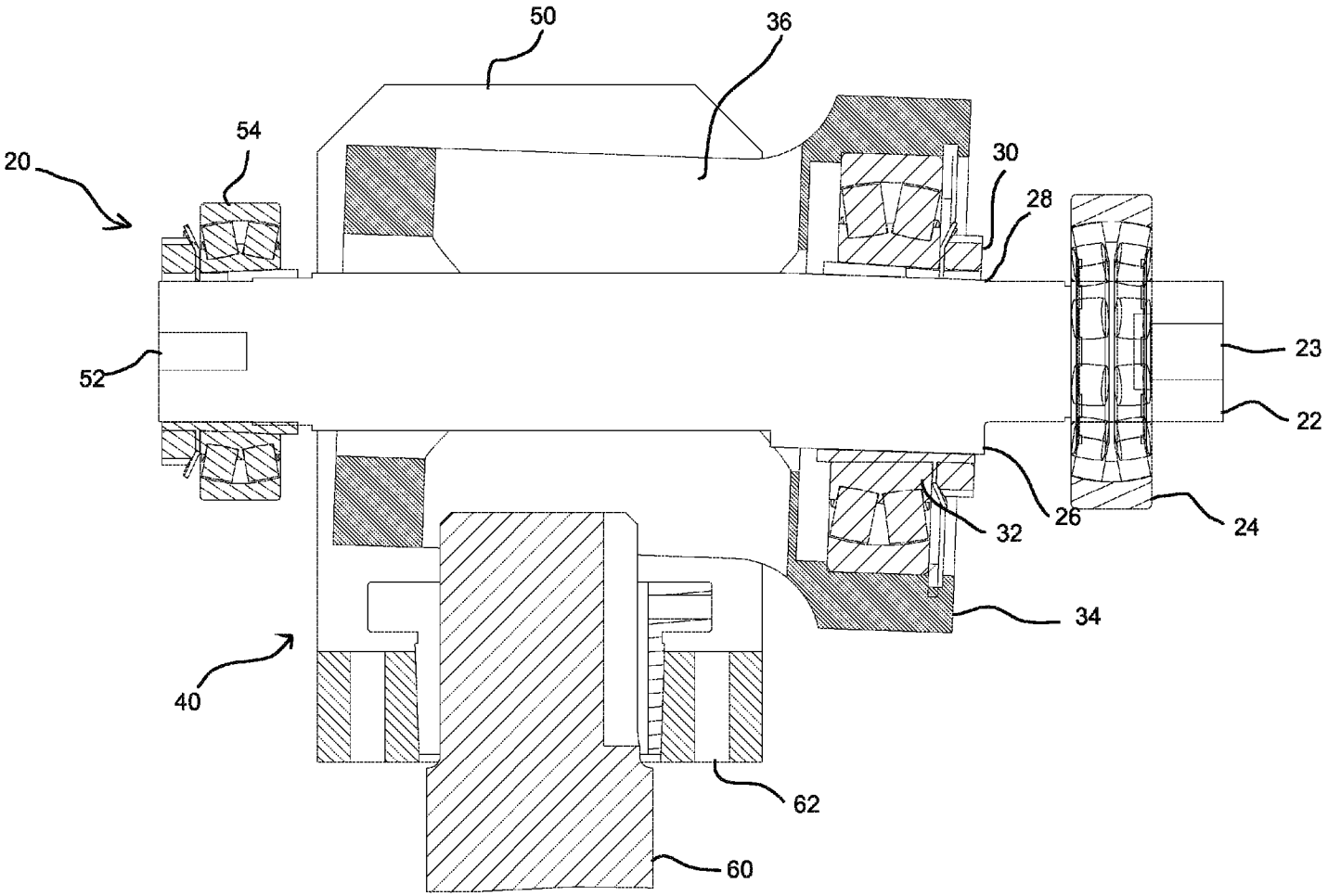
FIG. 2C is a sectional view of the SCO tamper drive in the third position.
Figure 2D:
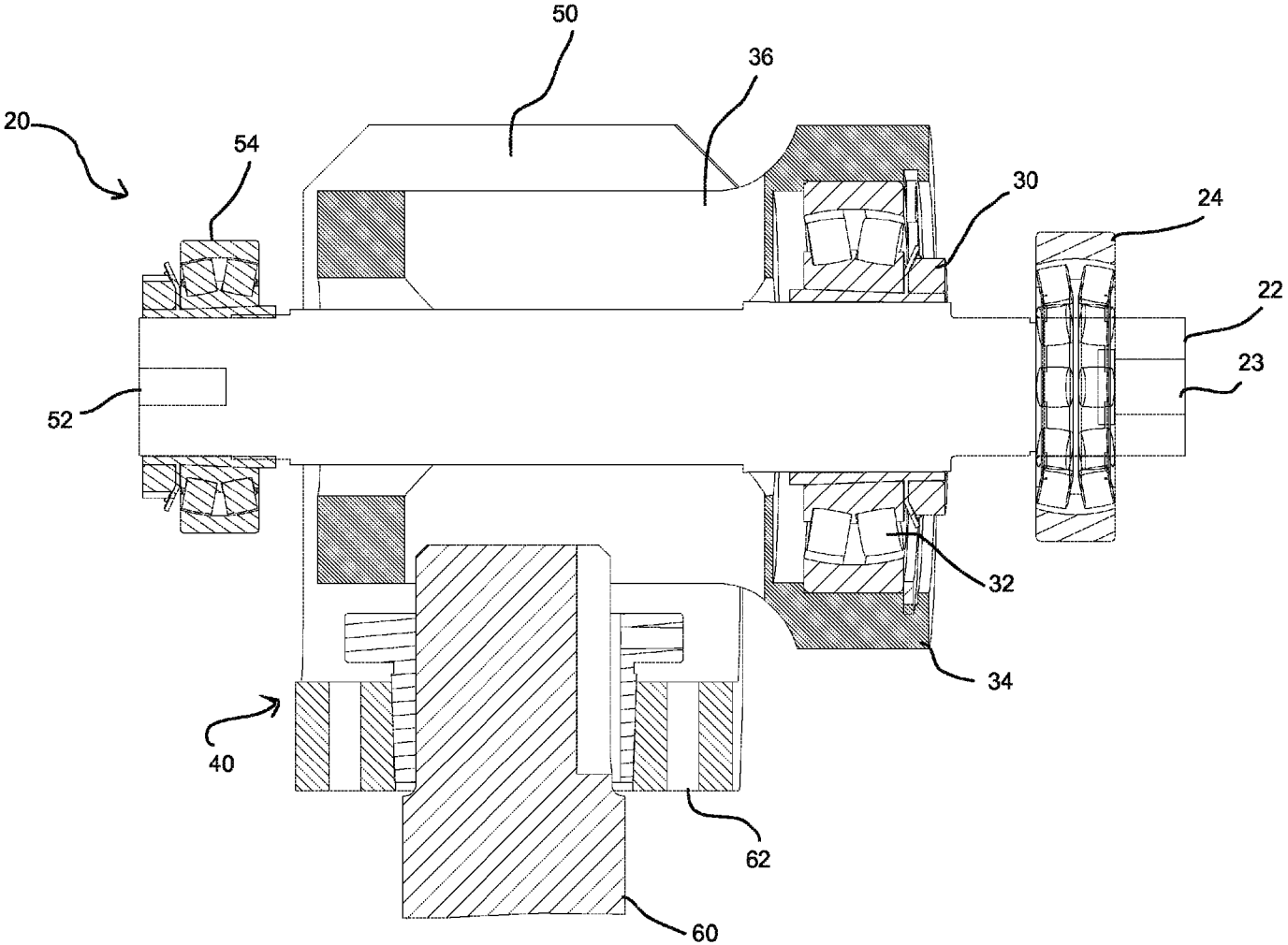
FIG. 2D is a sectional view of the SCO tamper drive in the fourth position.
Figure 2E:
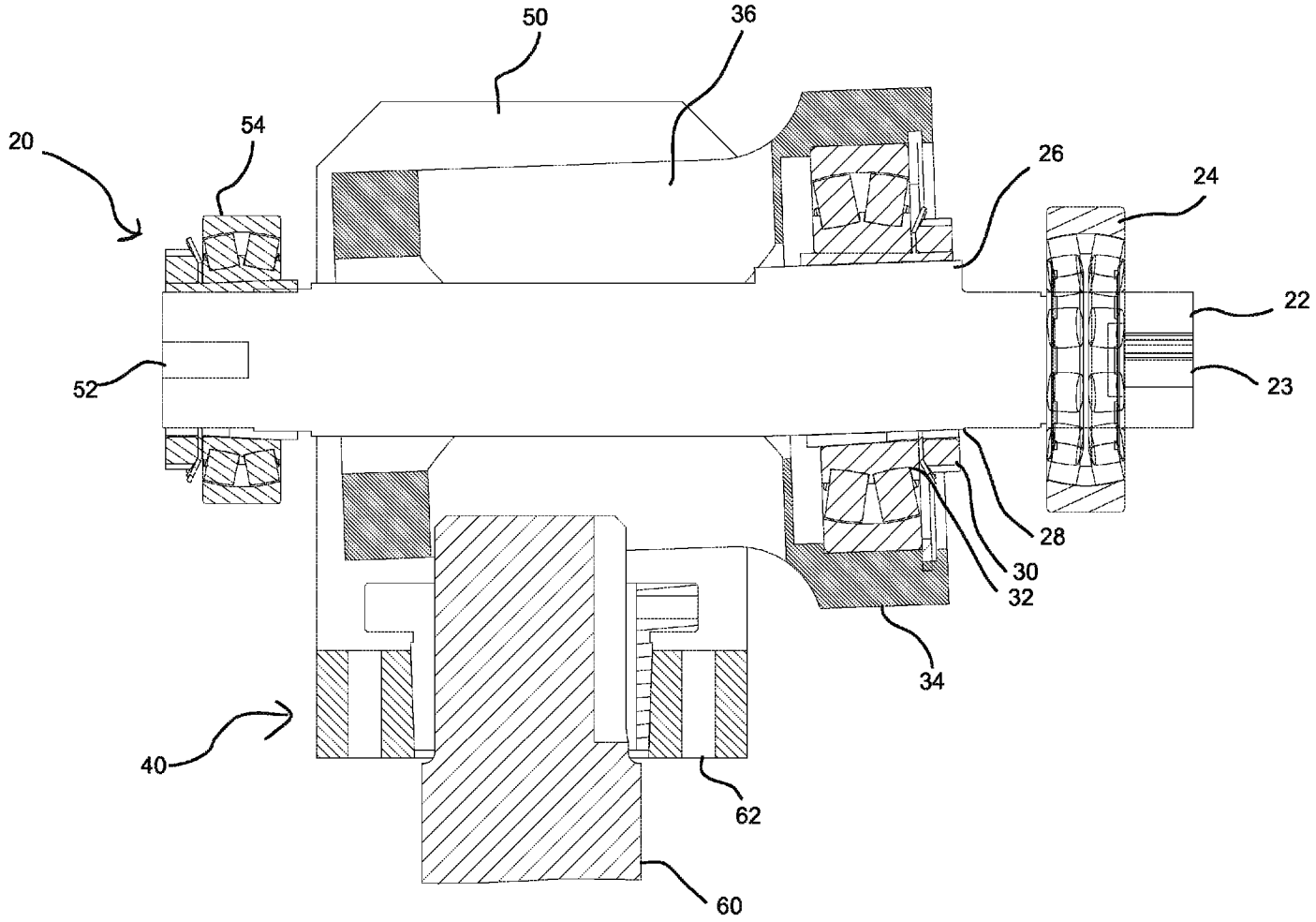
FIG. 2E is a sectional view of the SCO tamper drive in the fifth position.

Referring now to FIGS. 1A-1E and 2A-2E, a spatial crank oscillation (SCO) tamper drive, generally designated 20, is shown. The tamper drive 20, and other tamper drives presently disclosed, are preferably integrated into a ballast tamper apparatus that can be self-propelled or otherwise movable along a railroad track. Non-limiting example ballast tamper apparatuses are shown and described in U.S. Pat. Nos. 3,901,159, 4,240,352, 4,282,815, 4,369,712, 3,177,813, 3,343,497, 3,429,277, 6,386,114, 6,581,524, and commonly assigned U.S. Patent Provisional Application Ser. No. 61/882,190, filed Sep. 25, 2013, entitled "ROADWORTHY RAILROAD BALLAST TAMPER APPARATUS", which are incorporated in their entirety by reference herein.

As will be appreciated by those of ordinary skill in the art, an actuator such as but not limited to a pump (not shown), preferably hydraulic, can be driven by an engine (not shown) to provide power for various tools associated with a tamper apparatus, including drive power for the presently described tamper drives. During railroad track maintenance, a ballast tamping unit, which is equipped with the present tamper drive, performs packing of the ballast under railroad ties (not shown) for correcting cross and longitudinal levels of a pair of rail (not shown) of the railroad track.

In this embodiment, the SCO tamper drive 20 includes a wobble shaft (input shaft) 22 which is configured to be coupled via a link 23 (FIG. 2A) to a driver, such as a hydraulic motor, examples of which will be appreciated by those of ordinary skill in the art. The wobble shaft 22 is disposed within a first bearing 24, and rotates within the bearing with respect to a central horizontal axis. The bearing 24 is preferably constrained to rotational movement about the central horizontal axis, such as but not limited to by being fixedly coupled to a frame (not shown) of a tamper unit or otherwise coupled to the tamping apparatus.

An offset lobe or eccentric portion 26 of the wobble shaft 22 is disposed within an eccentric hub recess 28, which includes an outer locking ring 30 configured to engage with an inner ring 32 of a second, movable bearing 34. The eccentric portion 26 of the wobble shaft 22 is sized to fit within the eccentric hub recess 28 so that the eccentric portion rotates with the eccentric hub recess. As best viewed in FIG. 2A, the eccentric portion 26 is angled relative to the rotation axis of the wobble shaft 22. This allows the movable bearing to remain in the same plane as the inner and outer rings of the bearing, except for manufacturing tolerances. The movable bearing 34 includes an outer housing 36 that is coupled to a pair of laterally opposed drive pins 38, which are rotatingly mounted within a yoke 40.

As will be described below, a feature of the drive system 20 is that the eccentric mechanism is mounted on the axially swiveling yoke 40, which causes the reciprocal movement of the tamper tools. As such, the number of linkage components is significantly reduced, compared to conventional tamper drive systems. The first and second pins 38 are rotatably disposed within third and fourth laterally opposed bearings 48 (one is visible in FIG. 1A), which are fixably mounted to respective surfaces 50 of the yoke 40. A longitudinally opposed end of the wobble shaft 22 is disposed in a fifth, horizontal bearing 54 for rotation about the central axis, and this bearing preferably also is constrained similarly to the first bearing 24. A pin 52 (FIGS. 2A-2E) is preferably provided for constraining the opposed end of the wobble shaft 22.

Rotation of the eccentric portion 26 of the wobble shaft causes the second bearing 34 to itself rotate, preferably such that the housing 36 moves as an entire unit, as shown in the five positions respectively depicted in FIGS. 1A-1E and 2A-2E. This rotation includes a horizontal component and a vertical component. The spherical roller bearing 34 is able to rotate and maintain its planar relationship to inner ring 32 and an outer ring which contacts the recess in the outer housing 36. The third and fourth bearings 48 and the drive pins 38 coupled to the second bearing 34 allow reciprocal movement of the second bearing in the vertical direction. However, the pins 38 constrain the horizontal component of the second bearing 34 with respect to the yoke 40. This causes the yoke 40 to move reciprocally horizontally, along with the reciprocating horizontal movement of the second bearing. This accordingly transmits a reciprocating rotational movement to the yoke 40.

Figure 5A:
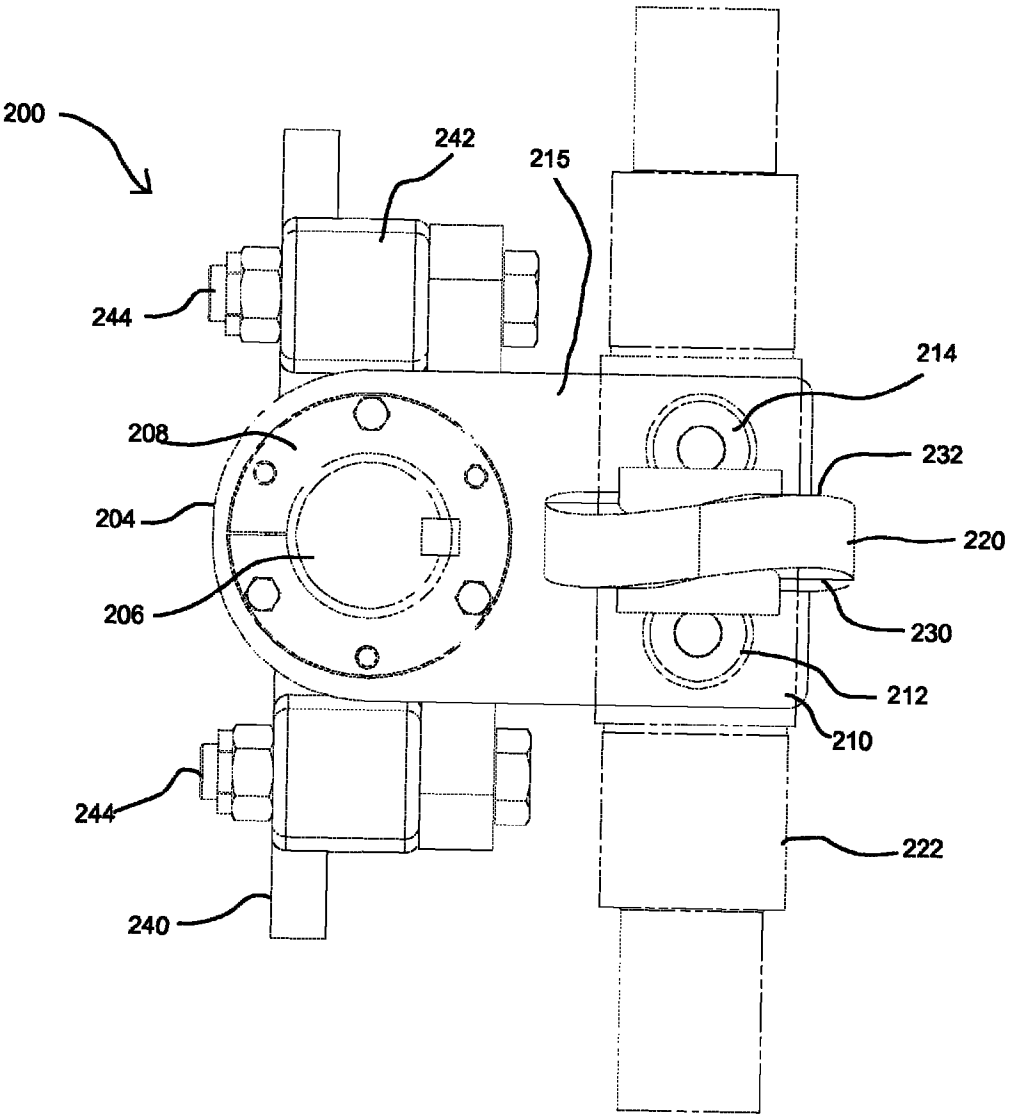
FIG. 5A is a sectional view of the barrel cam driven tamper drive of the third embodiment in a first position, in which a portion of a drive arm is shown in phantom.
Figure 5B:
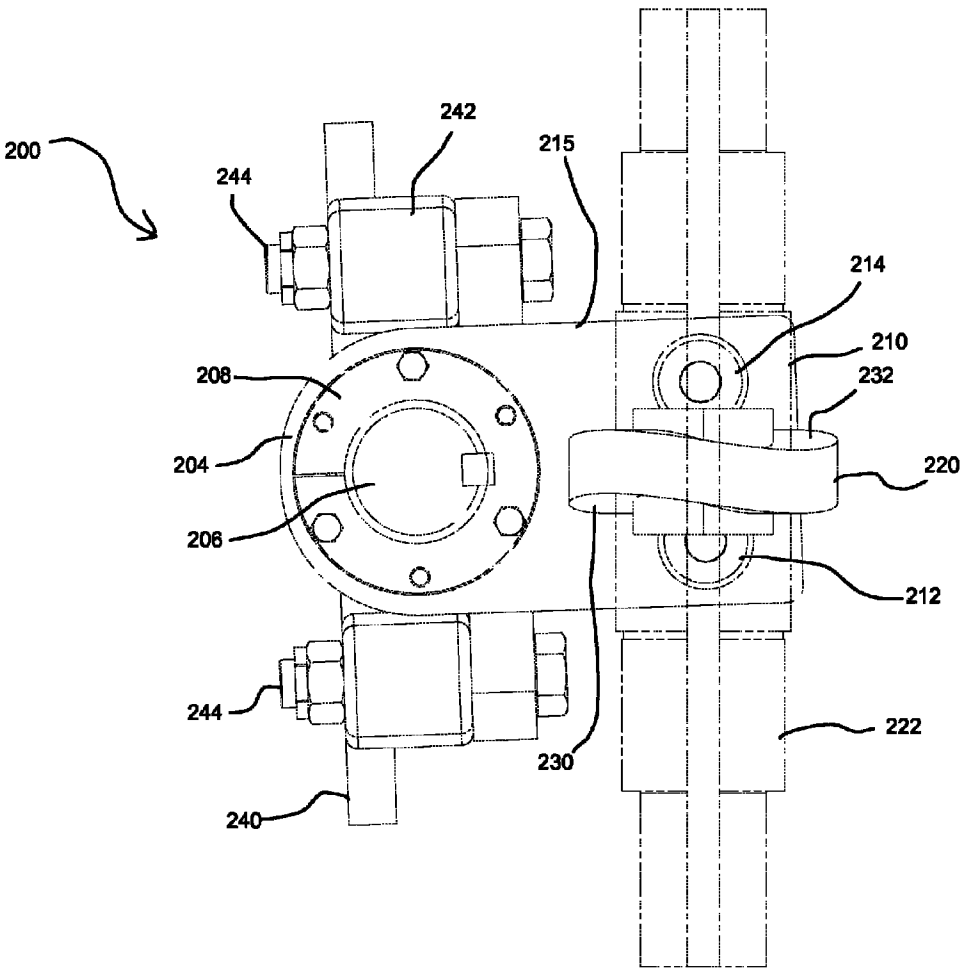
FIG. 5B is a sectional view of the barrel cam driven tamper drive of the third embodiment in a second position.
Figure 5C:
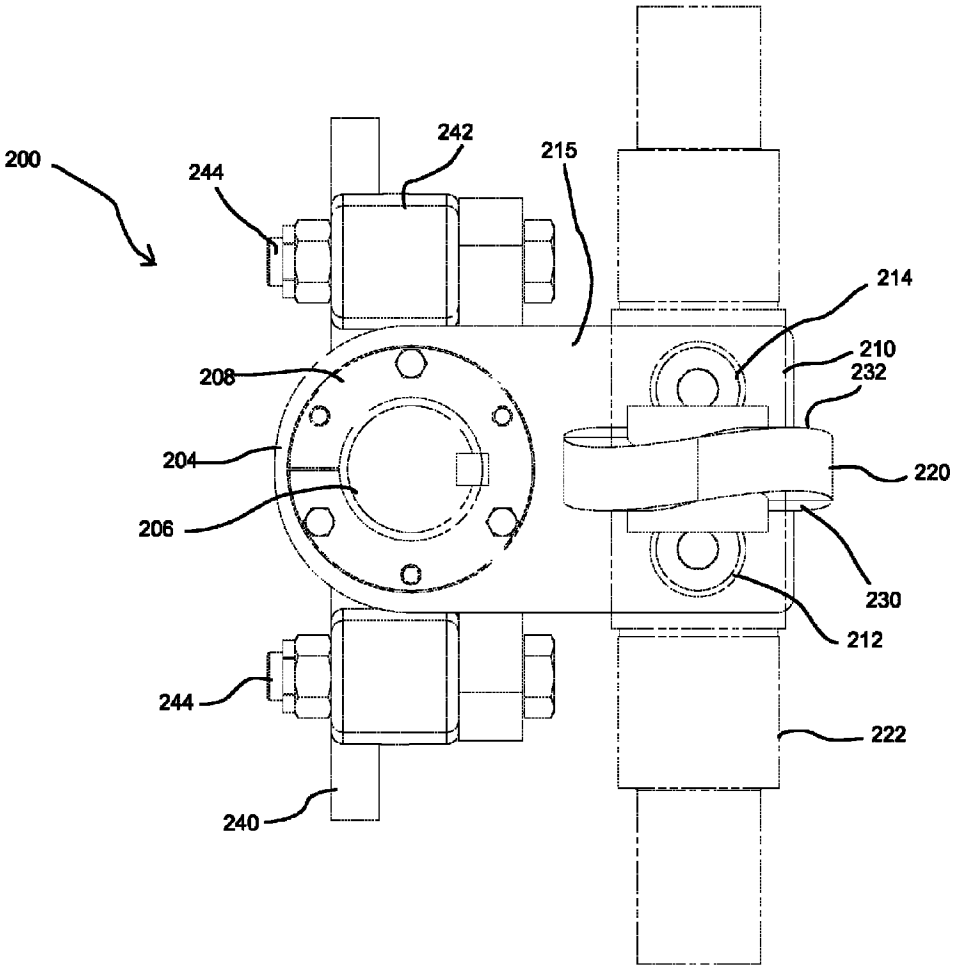
FIG. 5C is a sectional view of the barrel cam driven tamper drive of the third embodiment in a third position.
Figure 5D:
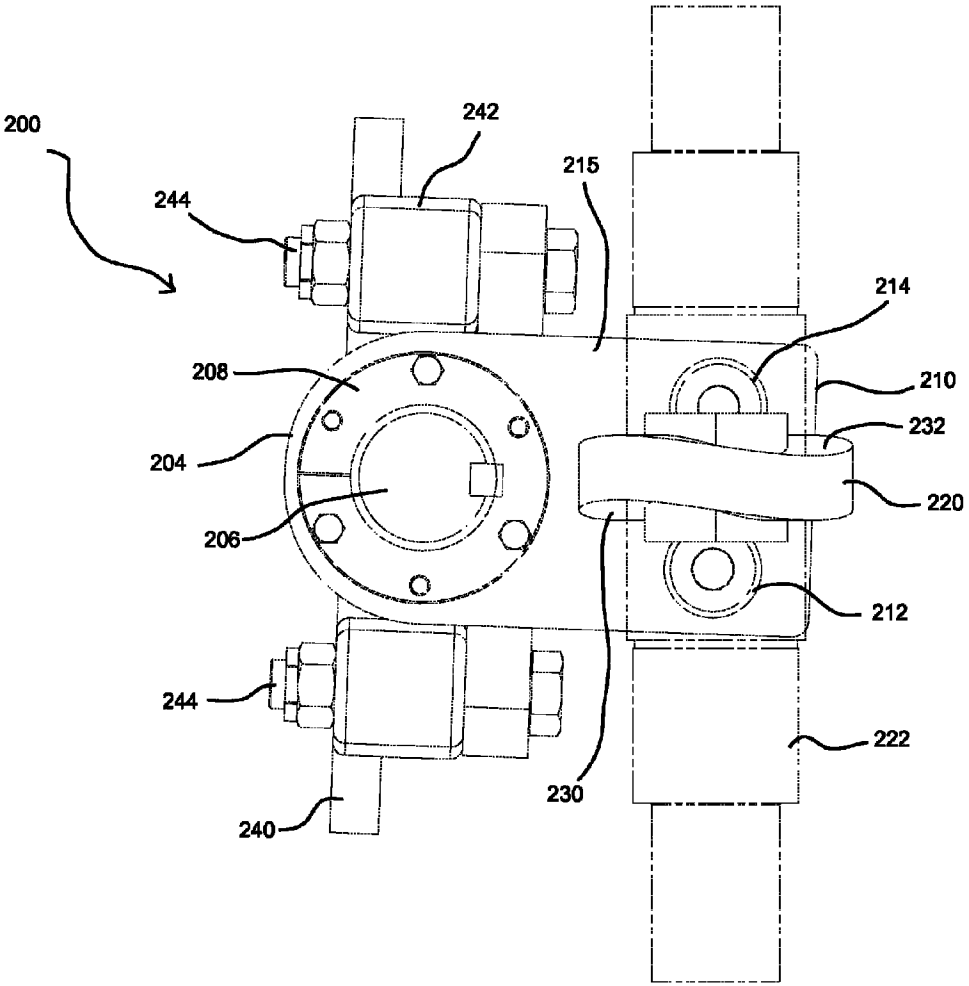
FIG. 5D is a sectional view of the barrel cam driven tamper drive of the third embodiment in a fourth position.
Figure 5E:
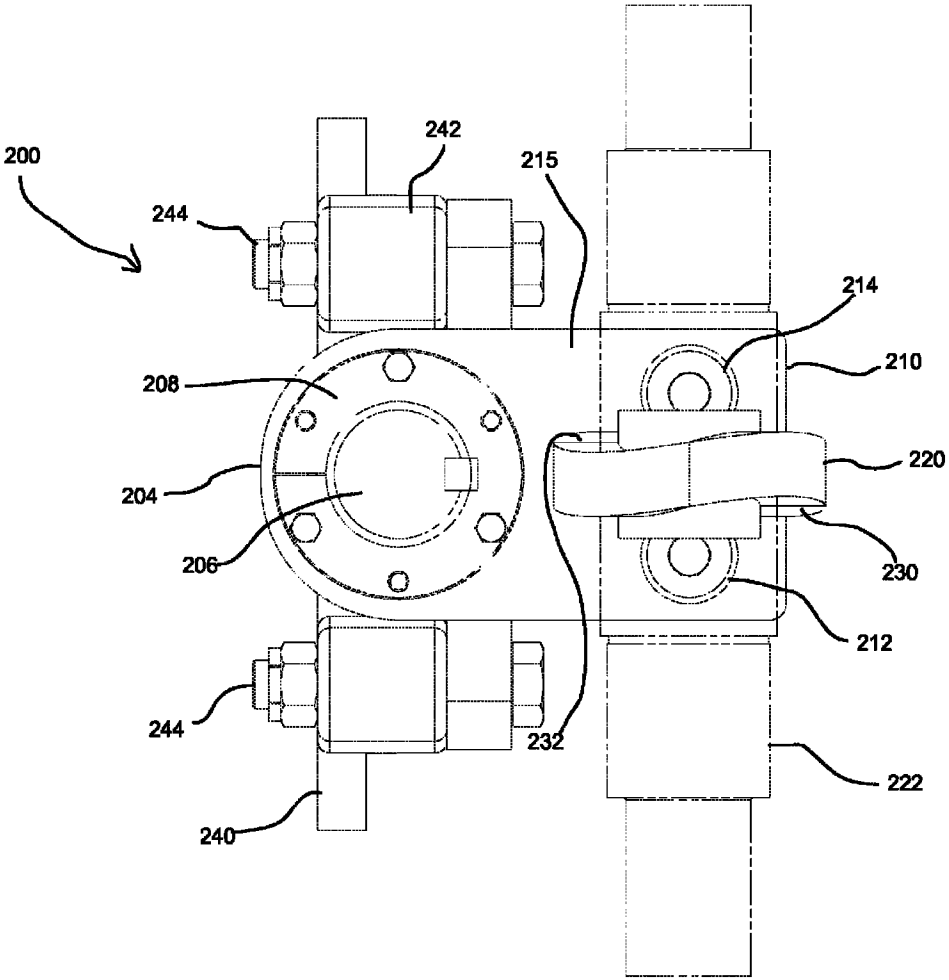
FIG. 5E is a sectional view of the barrel cam driven tamper drive of the third embodiment in a fifth position.

A drive shaft 60 is fixedly coupled to a lower portion 62 of the yoke 40 such that the drive shaft reciprocally rotates moves with the yoke about a vertical axis. The reciprocating movement of the yoke 40 causes a reciprocating rotational movement of the drive shaft 60, inducing vibration. Preferably one or more tamper arms or tools are fixedly coupled to the drive shaft, as will be appreciated by those of ordinary skill in the art. An example coupling is shown in FIGS. 5A-5E. Thus, rotation of the wobble shaft 22 about the horizontal central axis causes the drive shaft 60 to reciprocally rotate about the vertical axis and thus induces a vibrational motion to the tamper arms. Allowing the second bearing 34 to move as a unit, as opposed to having an eccentric hub recess rotate within a bearing, reduces wear on bearing components, and thus preferably extends the life of the tamper drive 20 compared to conventional tamper drives.

Figure 3A:
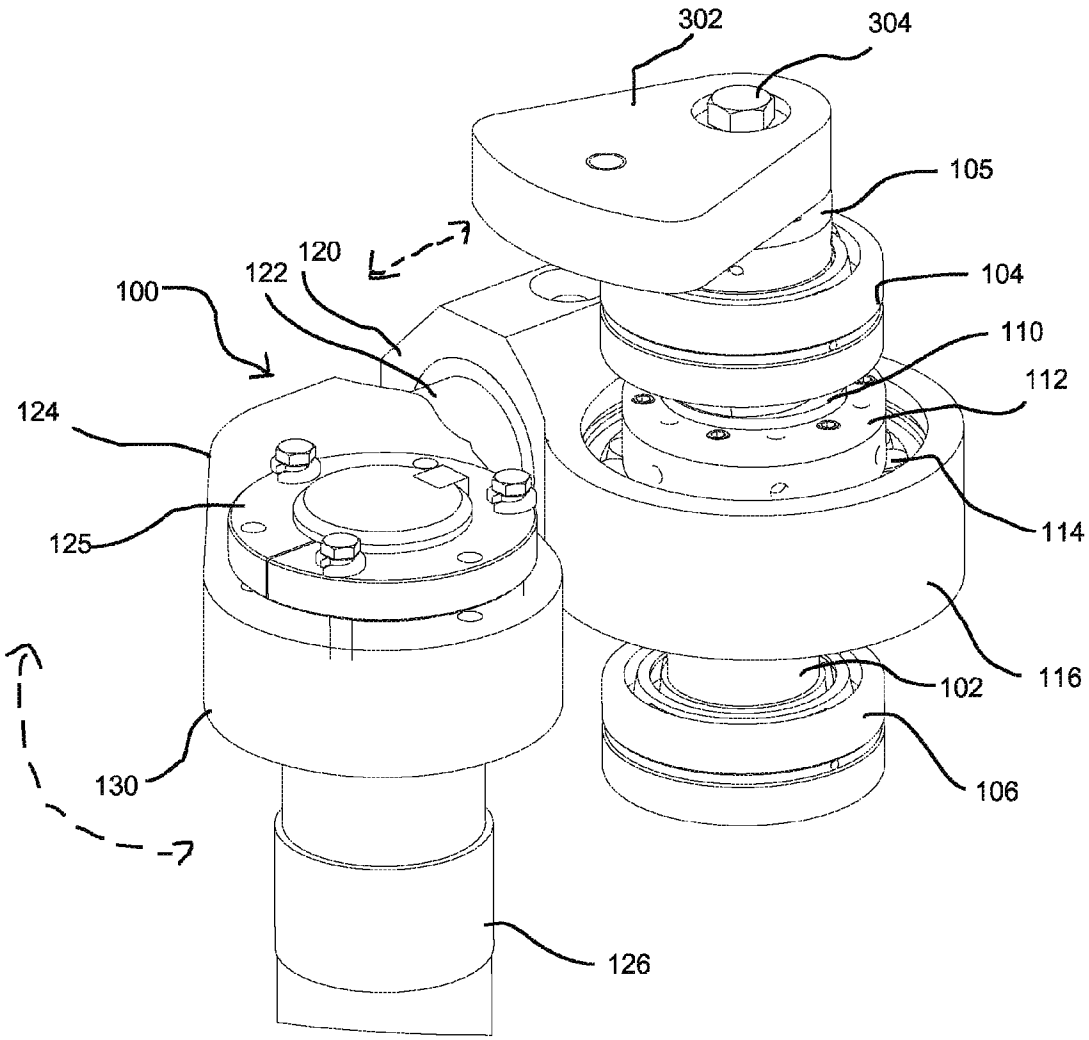
FIG. 3A is a perspective view of a sliding pin tamper drive according to a second embodiment of the present invention, at a first position, in which a counterweight is shown in phantom.
Figure 3B:
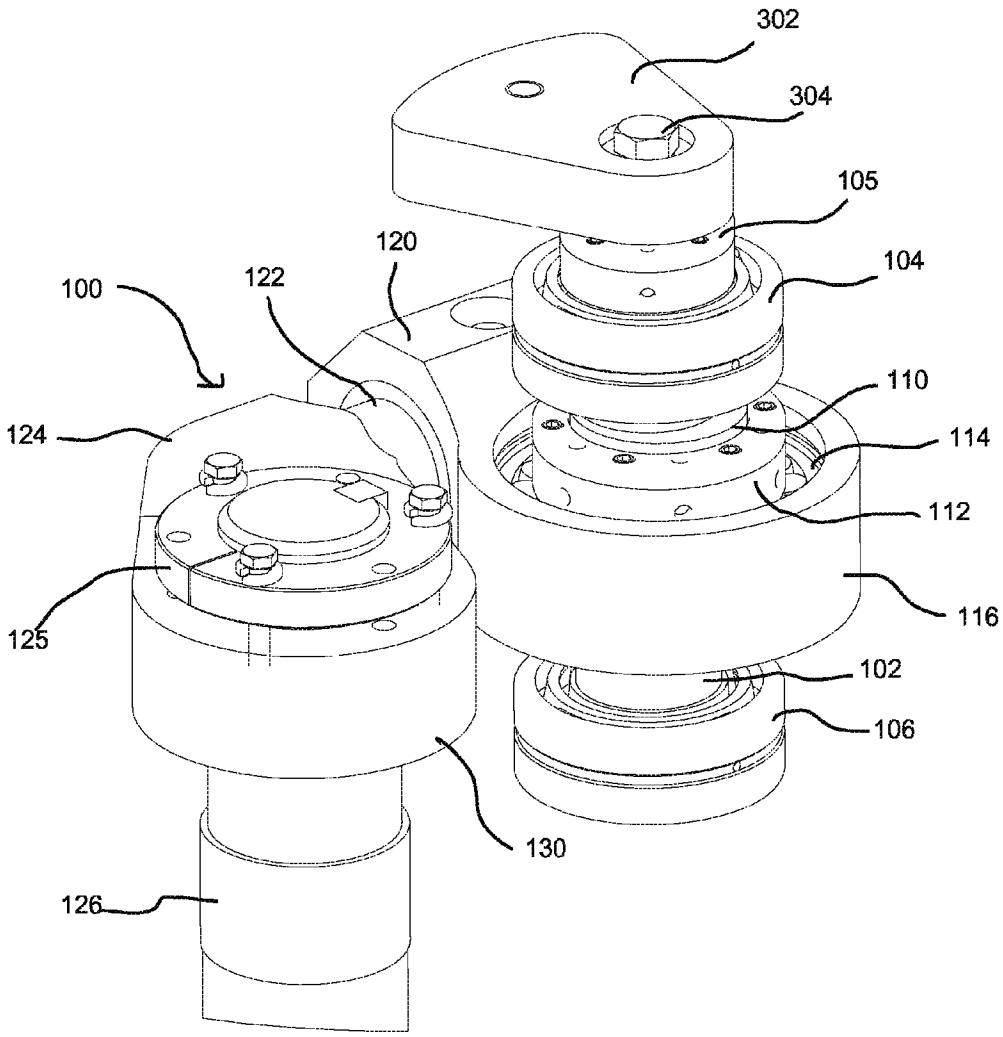
FIG. 3B is a perspective view of the sliding pin tamper drive according to the second embodiment, at a second position.
Figure 3C:
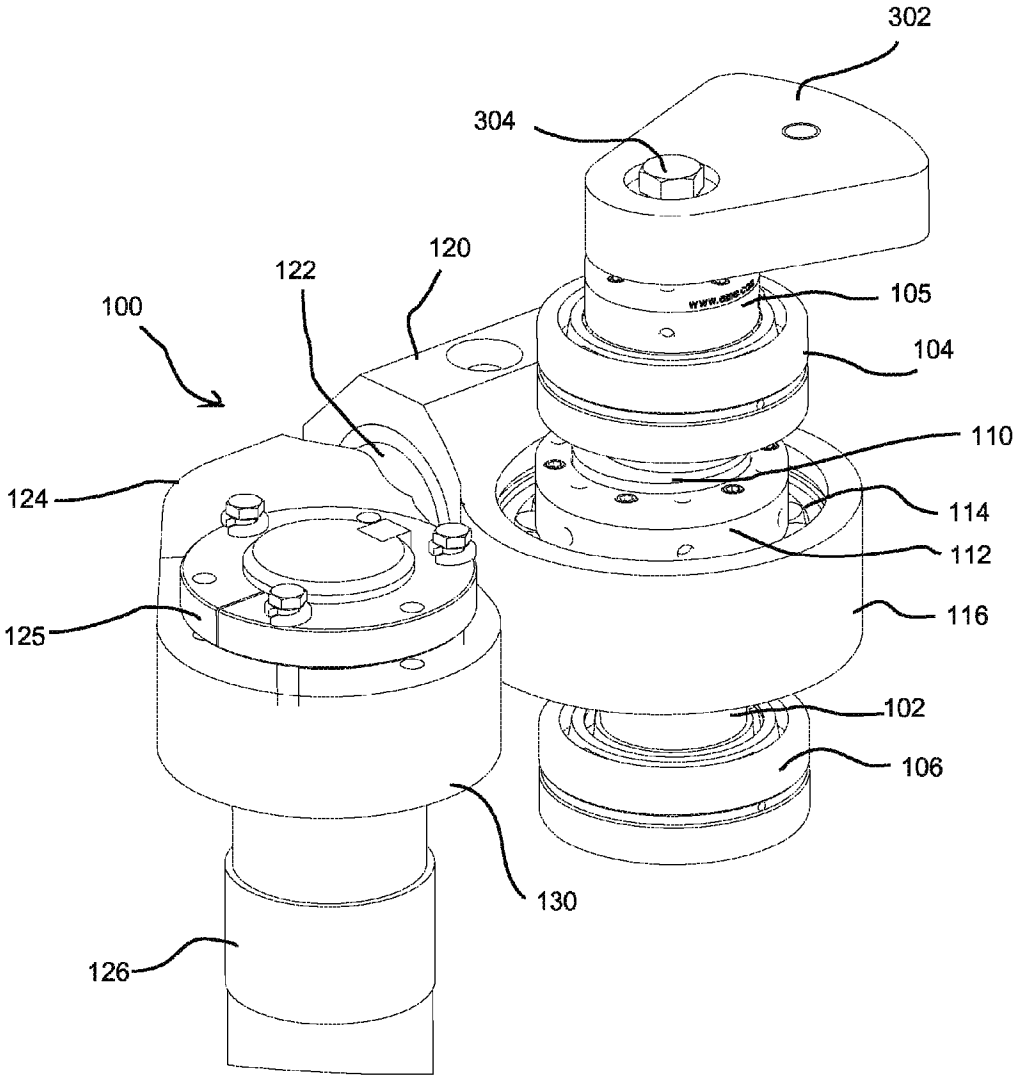
FIG. 3C is a perspective view of the sliding pin tamper drive according to the second embodiment, at a third position.
Figure 3D:
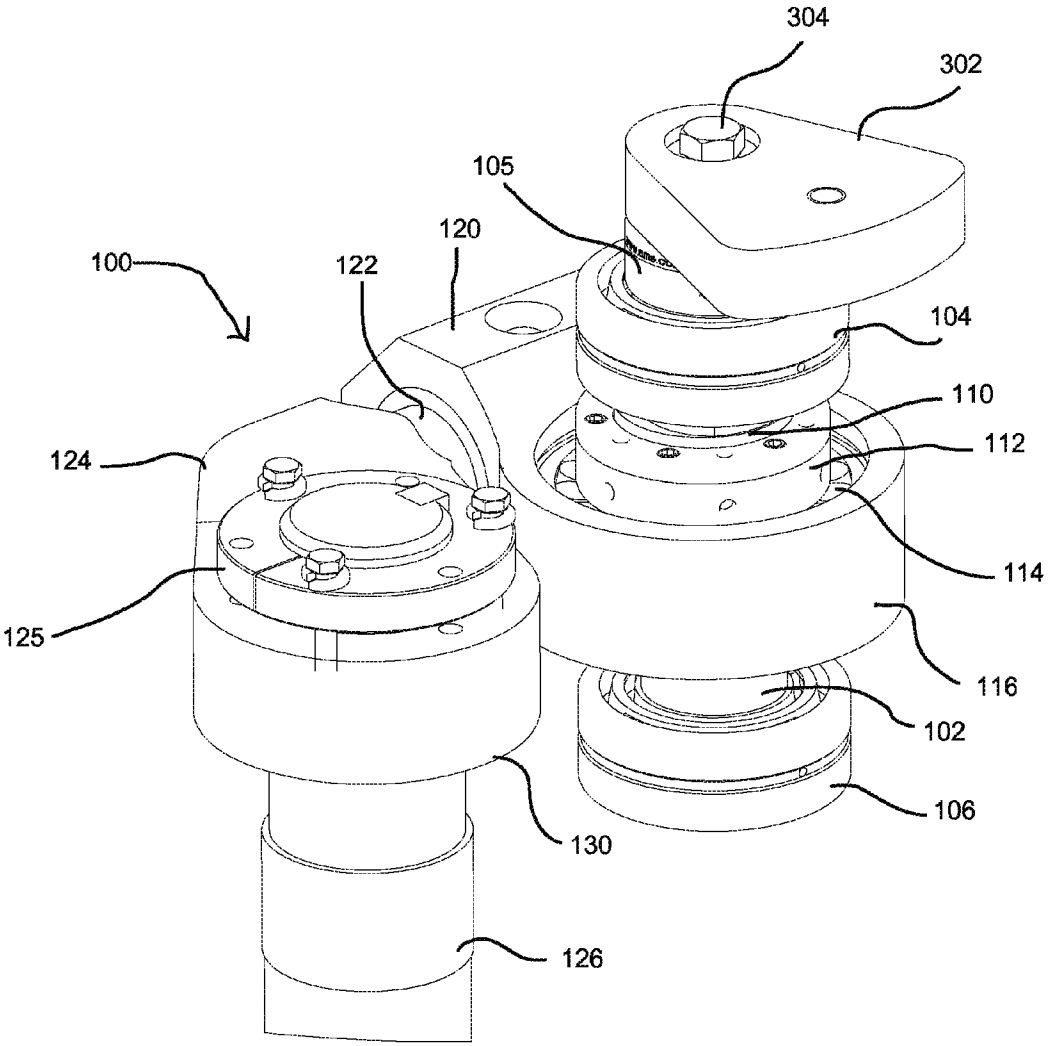
FIG. 3D is a perspective view of the sliding pin tamper drive according to the second embodiment, at a fourth position.
Figure 3E:
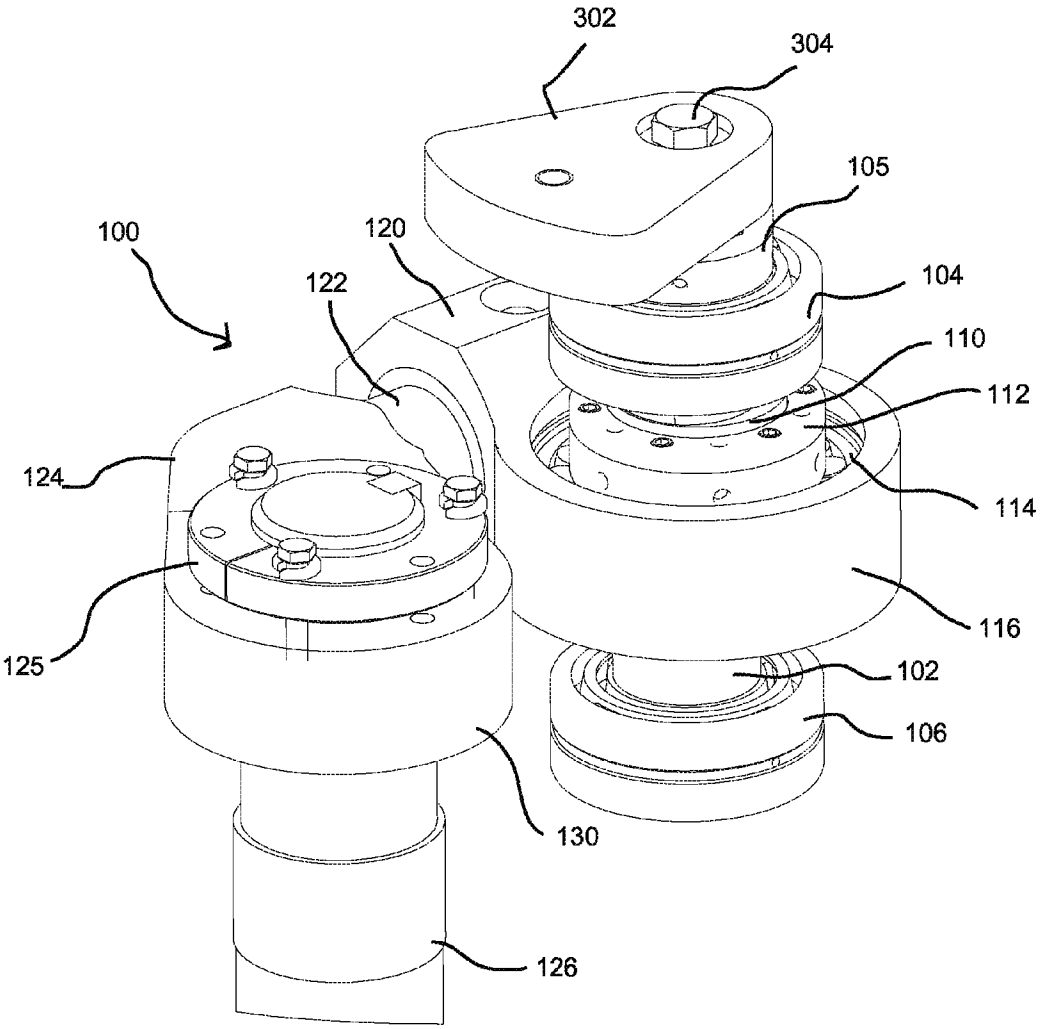
FIG. 3E is a perspective view of the sliding pin tamper drive according to the second embodiment, at a fifth position.
Figure 3F:
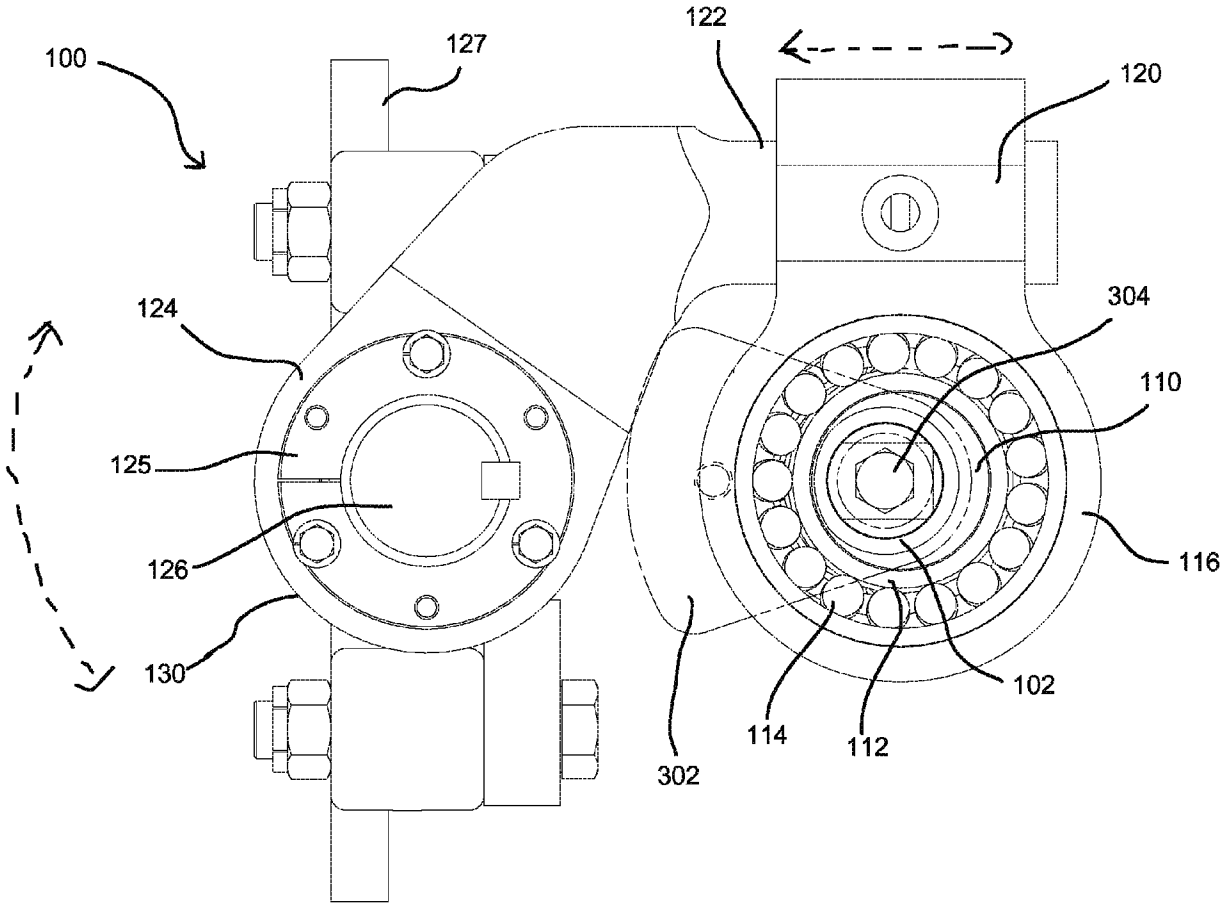
FIG. 3F is a partial cross-section view of the sliding pin tamper drive according to the second embodiment, at a zero degree position.
Figure 3G:
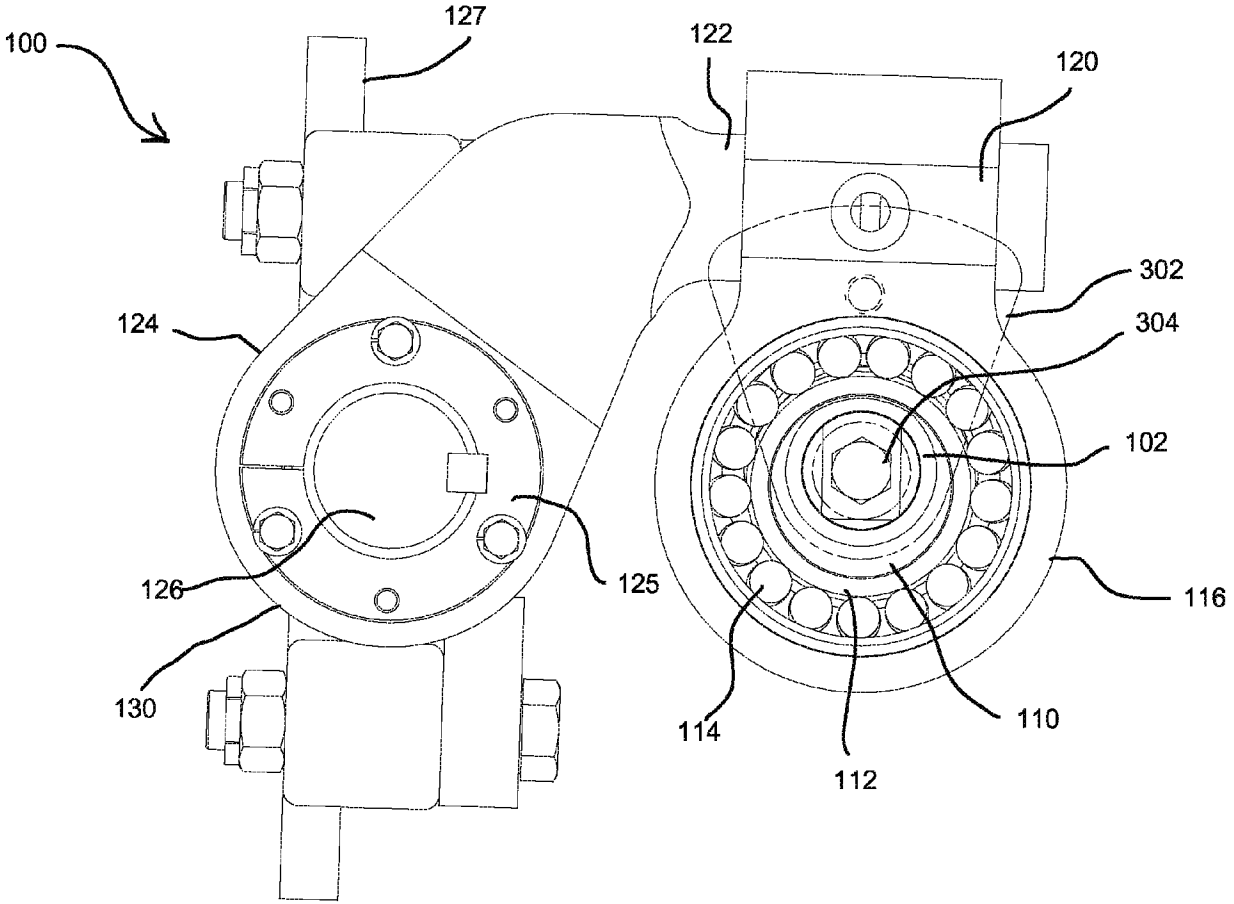
FIG. 3G is a partial cross-section view of the sliding pin tamper drive according to the second embodiment, at a 90 degree position.
Figure 3H:
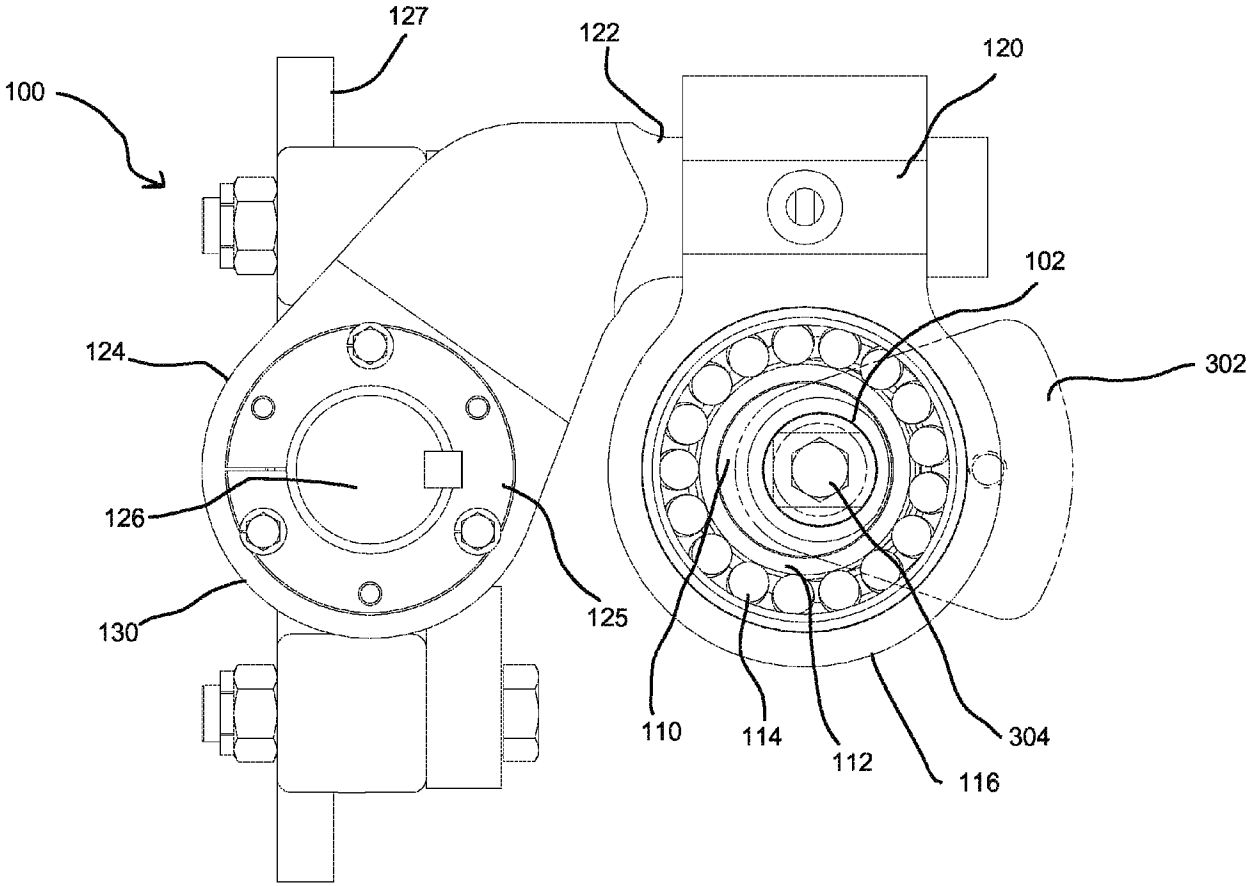
FIG. 3H is a partial cross-section view of the sliding pin tamper drive according to the second embodiment, at a 180 degree position.
Figure 3I:
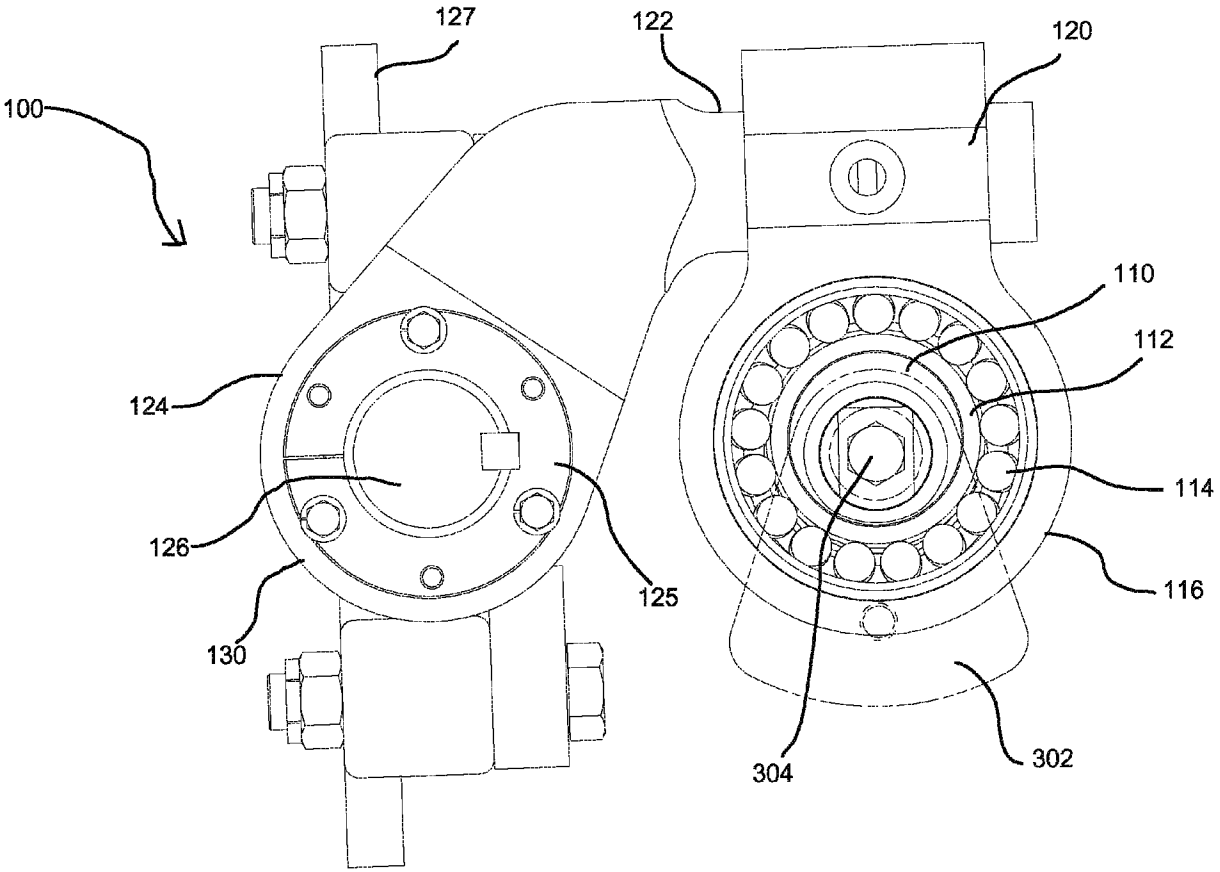
FIG. 3I is a partial cross-section view of the sliding pin tamper drive according to the second embodiment, at a 270 degree position.
Figure 3J:
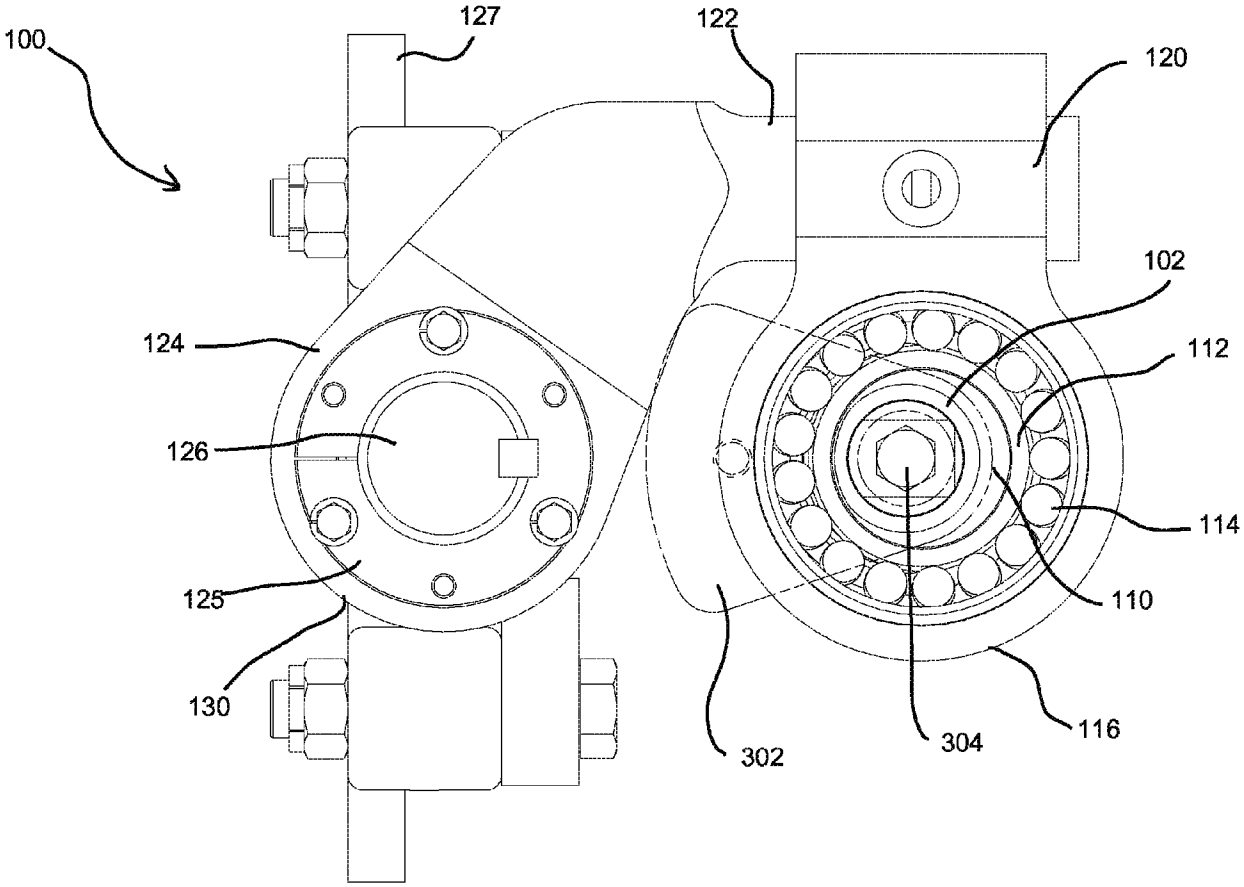
FIG. 3J is a partial cross-section view of the sliding pin tamper drive according to the second embodiment, at a 360 degree position.
Figure 4A:
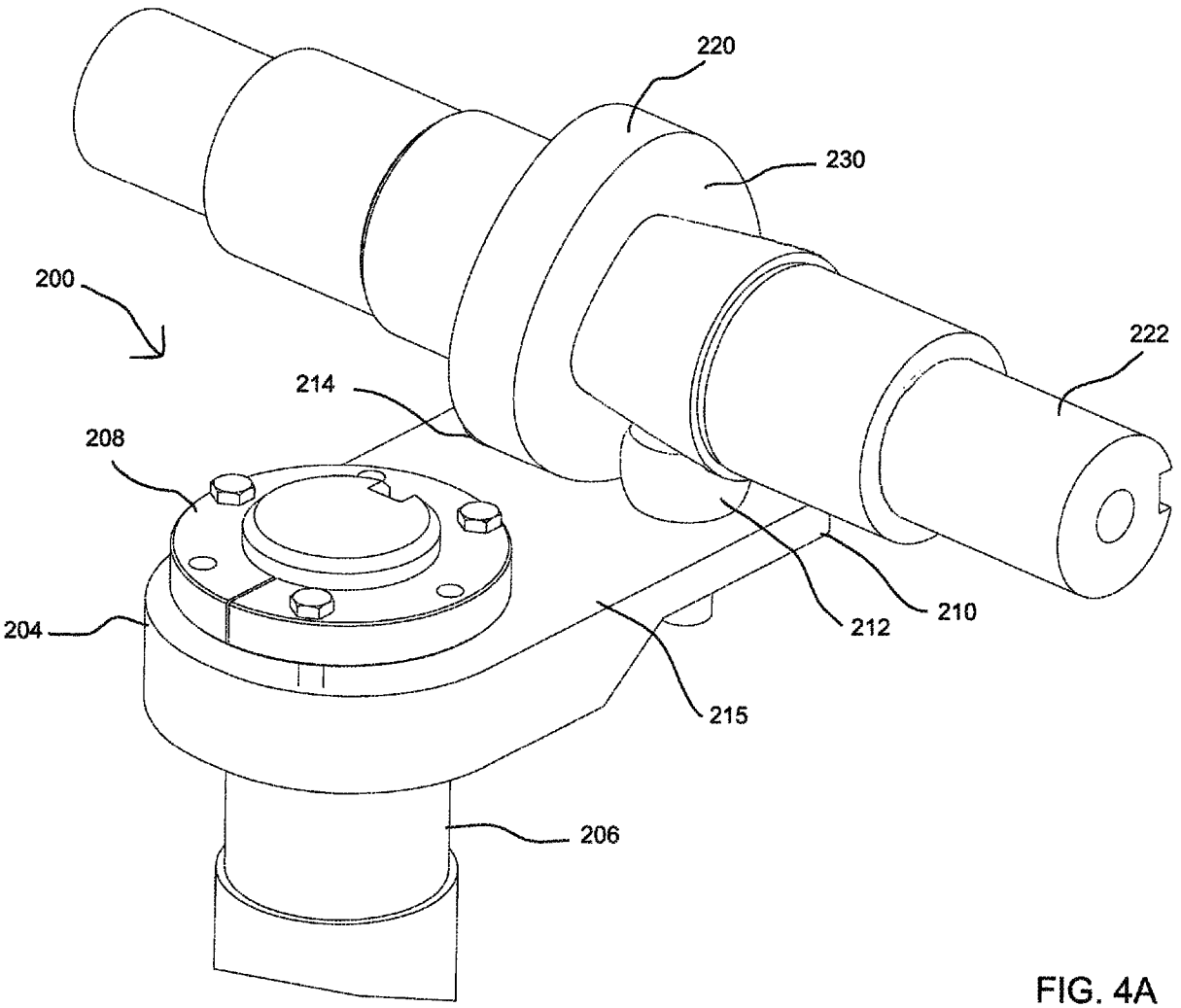
FIG. 4A is a perspective view of a barrel cam driven tamper drive according to a third embodiment of the invention, at a first position.
Figure 4B:
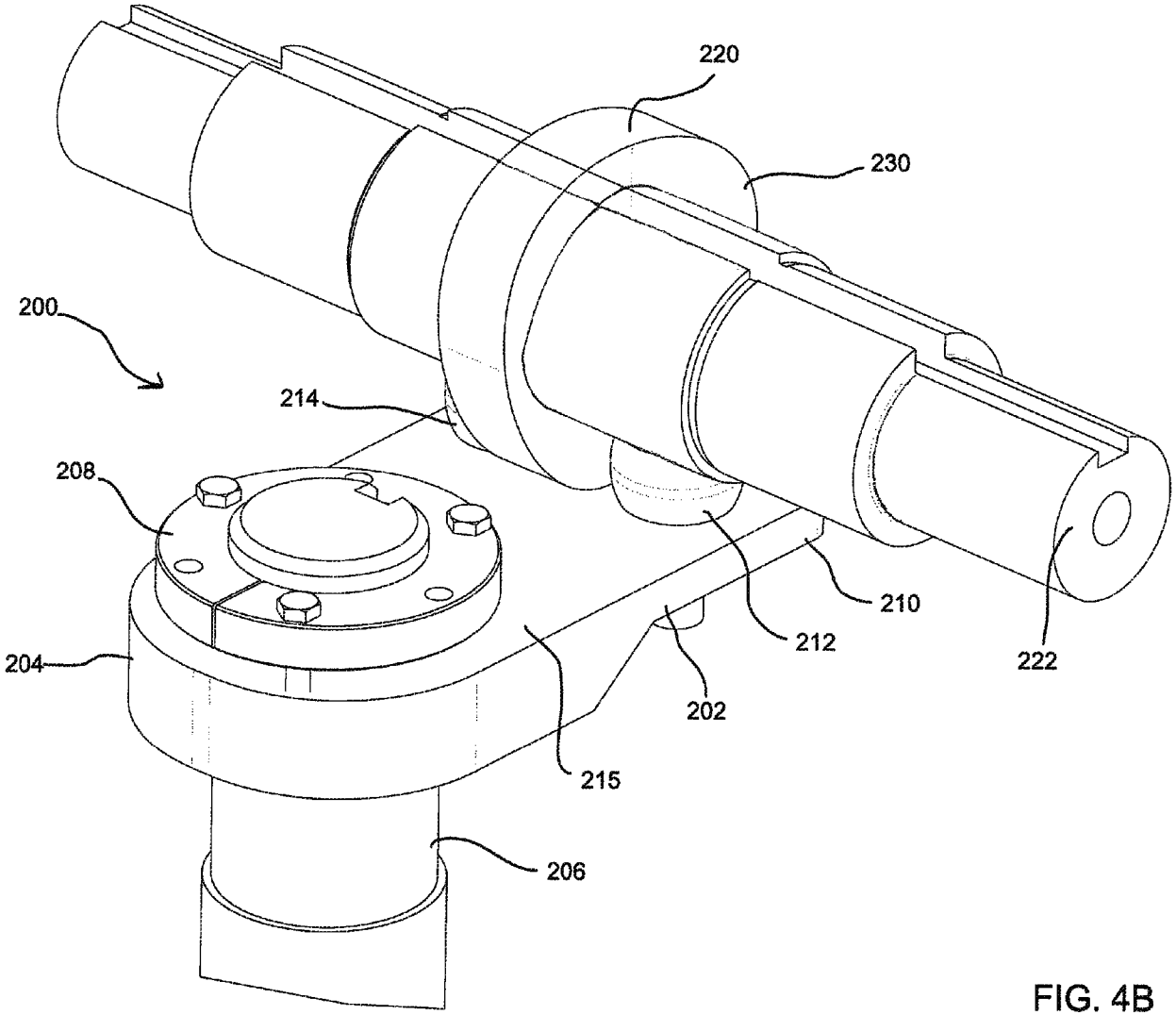
FIG. 4B is a perspective view of a barrel cam driven tamper drive according to the third embodiment, at a second position.
Figure 4C:
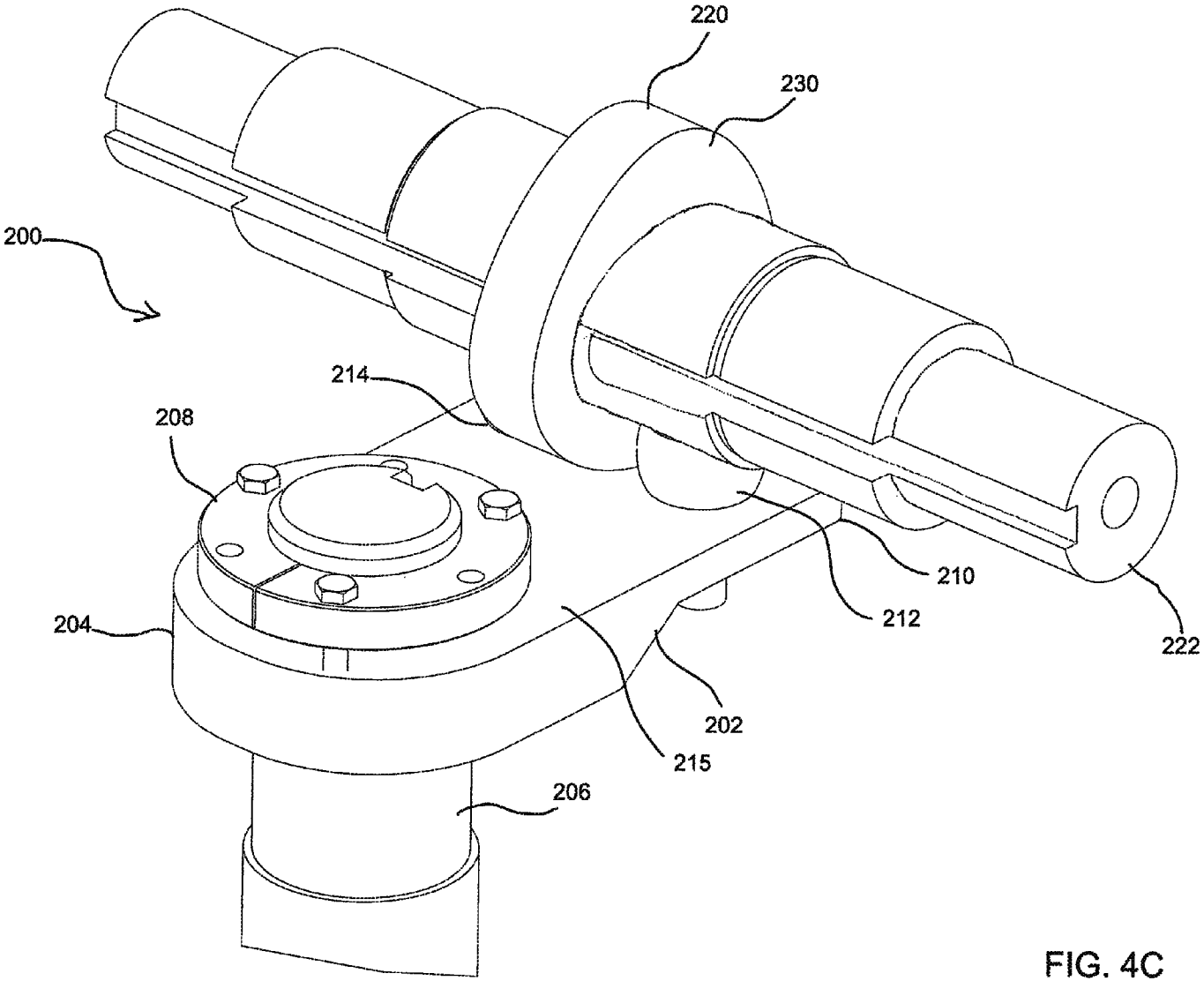
FIG. 4C is a perspective view of a barrel cam driven tamper drive according to the third embodiment, at a third position.
Figure 4D:
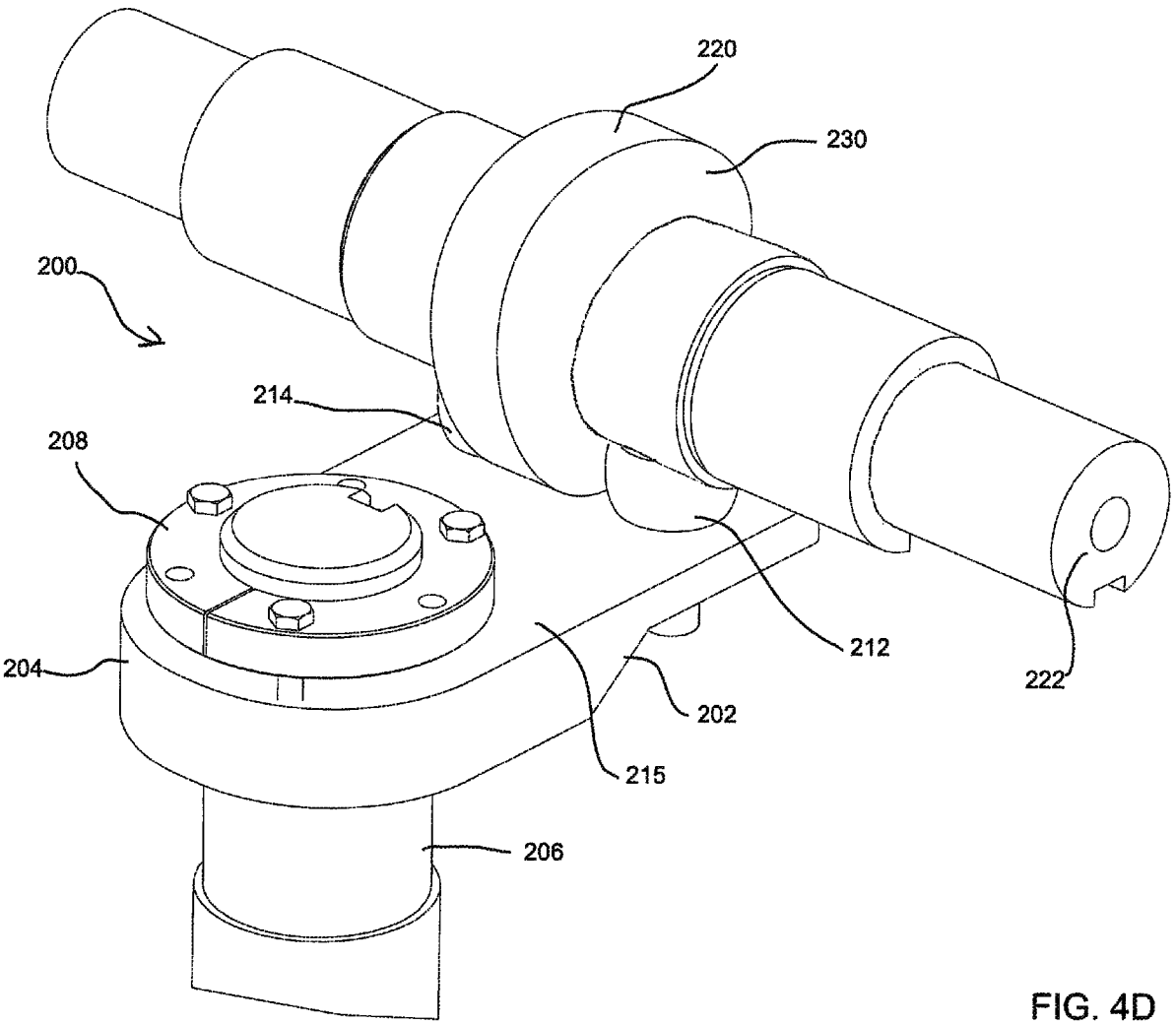
FIG. 4D is a perspective view of a barrel cam driven tamper drive according to the third embodiment, at a fourth position.
Figure 4E:
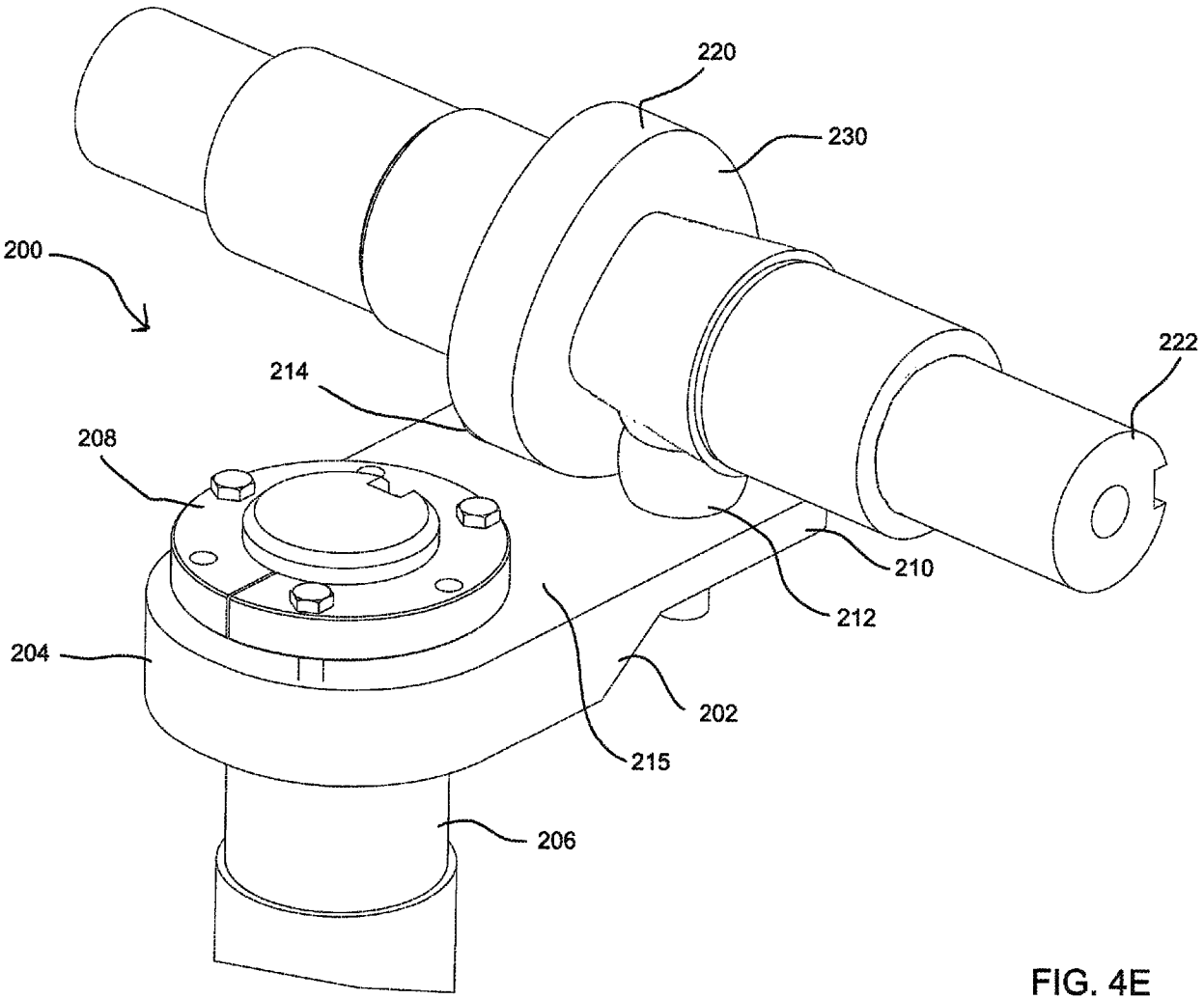
FIG. 4E is a perspective view of a barrel cam driven tamper drive according to the third embodiment, at a fifth position.

Referring now to FIGS. 3A-3J, a sliding pin tamper drive, generally referred to as 100, is provided, according to a second embodiment. The sliding pin tamper drive includes an eccentric wobble shaft (vertical input shaft) 102 disposed to rotate about a central vertical axis, which is parallel to the axis of rotation of the tamper tools or arms. It will be appreciated that "vertical" as discussed here is with respect to the orientation shown in FIGS. 1A-1E, 3A-3E, and 4A-4E. The wobble shaft 102 is disposed within first (e.g., upper) and second (e.g., lower) bearings 104, 106 for rotation about the vertical axis within the bearings. For securing the upper bearing 104, a separate threaded lock-nut 105 is provided. The bearings 104, 106 may be constrained, e.g., may be mounted to a frame or other suitable main tamper unit housing (not shown) as will be appreciated by those of ordinary skill in the art. Pins (not shown) are preferably provided to constrain the wobble shaft 102, and a link (not shown) is preferably provided for coupling the wobble shaft to a suitable actuator, such as a hydraulic motor.

An offset lobe or eccentric portion 110 of the wobble shaft 102 is fixedly disposed in a ring of an eccentric hub recess, which is disposed within a separate threaded lock-nut 112 to secure a third (e.g., middle) bearing 114. The middle bearing 114 is provided as part of an offset lobe 116. An opposed end of the offset lobe 116 includes a slide chamber 120 through which a horizontal pin 122 of (or integrated with, or fixedly coupled to) a crank arm 124 is slidingly disposed for relative linear movement. An opposing end of the crank arm 124 is fixedly coupled such as via mounting, e.g., a tapered hub 125 to a tamper tool drive shaft 126, which generally extends along a second vertical axis and can be fixedly coupled to tamper arms 127, as viewed in FIGS. 3F-3J. As the shaft 102 rotates, the slide chamber 120 reciprocates horizontally in the depicted orientation with the offset lobe 116, which rotates with the eccentric portion 110 of the wobble shaft 102.

As the first and second bearings 104, 106 through which the wobble shaft 102 rotates about the first vertical axis are preferably constrained, rotation of the eccentric portion 110 of the wobble shaft causes the offset lobe 116 to rotate, as shown by the five positions depicted in FIGS. 3A-3E. The slide chamber 120 of the offset lobe 116 allows reciprocating linear movement of the horizontal pin 122, which transfers reciprocal movement to the crank arm 124. The resulting reciprocal movement of the crank arm 124 causes a reciprocal rotation of the opposed end 130 of the crank arm, and thus reciprocal rotation of the fixedly coupled drive shaft 126. This motion in turn preferably causes reciprocal rotation of tamper arms 127 fixedly coupled to the drive shaft 126, resulting in vibrational movement. The tamper arms 127 can be fixedly coupled to the drive shaft 126 as illustrated in FIGS. 3F-3J and FIGS. 5A-5E.

As shown in FIGS. 3A-3J, the sliding pin tamper drive 100 further includes a counterweight 302, made of a suitable material such as but not limited to metal. The counterweight 302 is preferably fixedly coupled to the wobble shaft 102 by a fastener such as but not limited to a bolt 304. Preferably, the counterweight is disposed just above the eccentric portion 110.

To dampen vibration of the second bearing 114 during rotational movement of the wobble shaft 102, the counterweight 302 preferably is disposed relative to the wobble shaft 102 such that a moment of inertia of the counterweight and the eccentric portion 110 preferably are opposed from one another with respect to the vertical central axis. In operation, the counterweight 302 opposes the horizontal sliding motion of the horizontal pin 122, and balances loading of the wobble shaft 102. This dampens or cancels vibration of the second bearing 114. The counterweight can further provide a flywheel that helps drive motion of the sliding pin tamper drive 300 via the momentum of swinging counterweight mass. However, the counterweight 302 is optional, and in other example embodiments the counterweight is omitted.

Another tamper drive, referred to herein as a barrel cam driving tamper drive, is generally disclosed at 200. Referring now to FIGS. 4A-4E and 5A-5E, the barrel cam driven tamper drive 200 includes an arm 202 having at one general end 204 a shaft 206 fixedly coupled thereto, such as via a mounting 208, and extending in a vertical direction. An opposed end 210 includes (or is coupled to) first and second cam followers 212, 214, which are preferably vertically disposed on an upper surface 215 of the arm 202.

A rotatable cam provides cam surfaces for engaging the cam followers 212, 214. For example, in the tamper drive 200, a barrel cam 220 is mounted to, or integrally formed with a driving arm 222, which in turn may be coupled by a suitable link (not shown) to a suitable tamper drive actuator such as a hydraulic motor, examples of which are well known in the art. Driven by the actuator, the driving arm 222 is oriented to rotate about a generally horizontal central axis.

The barrel cam 220 includes a pair of laterally opposed cam surfaces 230, 232 (one is viewable in FIGS. 4A-4E) that each engage a corresponding one of the first and second vertically oriented cam followers 212, 214. As such, the barrel cam 220 has a varying thickness around its periphery, and such variation determines the throw of the cam. The driving arm 222 may rotate, for instance, within opposed bearings (not shown), such as those shown in other embodiments herein or otherwise as will be appreciated by those of ordinary skill in the art, and such bearings can be fixedly coupled to a frame or other housing for the tamper drive or otherwise fixed, as would be appreciated by those of ordinary in the art, for constraining movement of the drive arm to rotation about the central horizontal axis.

The rotation of the drive arm 222 about the horizontal central axis and thus rotation of the barrel cam induces a reciprocal horizontal movement of the arm 202 due to the engagement of the cam surfaces 230, 232 with the first and second cam followers 212, 214. This in turn reciprocally rotates the opposing end of the arm, thus rotating the shaft. Preferably, one or more tamper arms 240, a portion of which is shown in FIGS. 5A-5E, are fixedly coupled to the drive shaft 206 via an upper frame 242 and fasteners such as bolts 244, such that reciprocal rotational movement of the drive shaft results in a reciprocal vibration movement of the tamper arms.

In another example tamper drive according to the third embodiment, the cam followers are positioned horizontally with respect to the arm 202, as opposed to the vertically oriented cam followers 212, 214. To provide the rotatable cam in this example embodiment, the drive arm 222 and cam surface 220 are replaced with a globoidal cam driver (not shown) for inducing reciprocal rotation of the arm 202. This alternate tamper drive preferably is otherwise configured according to the tamper drive 200.

The tamper drives disclosed herein can be positioned and controlled by an operator in a manner similar to other tamper drives as known in the art.

While particular tamper drive embodiments have been shown and described herein, it will be appreciated by those skilled in the art that changes and modifications may be made thereto without departing from the present disclosure in its broader aspects and as set forth in the following claims.

What is claimed is:

1. A tamper drive apparatus comprising:

a wobble shaft rotatable about a central horizontal axis and disposed within a first bearing, the wobble shaft including an eccentric portion of the wobble shaft fixedly coupled to an eccentric hub recess;

the eccentric hub recess being disposed within a movable bearing, wherein the axial rotation of the wobble shaft causes the eccentric hub recess to rotate within the movable bearing to induce rotation movement of the movable bearing;

a yoke coupled to the movable bearing such that rotation movement of the movable bearing causes the yoke to reciprocate horizontally; and a drive shaft fixedly coupled to the yoke;

wherein the reciprocal horizontal movement of the yoke and the drive shaft results in vibration of the yoke.

2. The tamper drive apparatus of claim 1, wherein the central horizontal axis is constrained such that the rotation of the eccentric hub recess induces rotation movement in the movable bearing.

3. The tamper drive apparatus of claim 1, wherein a horizontal component of rotation of the yoke is constrained such that rotational movement of the movable bearing causes the yoke to reciprocate horizontally.

4. The tamper drive apparatus of claim 1, wherein the drive shaft is fixedly coupled to at least one tamper arm, wherein the vibration of the yoke results in vibration of the tamper arms.

5. The tamper drive apparatus of claim 1, wherein the eccentric portion of the wobble shaft is fixedly coupled to a ring disposed within the eccentric hub recess.

6. The tamper drive apparatus of claim 1, further comprising:

a driver coupled to the wobble shaft to drive the tamper drive apparatus.

7. A tamper drive apparatus comprising:

a wobble shaft rotatable within a first bearing along a vertical central axis, the wobble shaft including an eccentric portion that is rotatable within a second bearing coupled to or integrated with an offset lobe, wherein rotation of the eccentric portion of the wobble shaft causes the offset lobe to rotate;

the offset lobe including a slide portion through which a horizontal pin of a crank arm is disposed for reciprocal linear sliding movement, wherein the slide and pin transmit a horizontal movement direction to the crank arm to reciprocally rotate an end of the crank arm about a second vertical axis;

a drive shaft fixedly coupled to the crank arm for reciprocally rotating about the second vertical axis; and one or more tamper arms fixedly coupled to the drive shaft for reciprocating movement.

8. The tamper drive of claim 7, wherein the vertical central axis is constrained.

9. The tamper drive of claim 7, wherein the eccentric portion is disposed within a ring, the ring being rotatable within the second bearing.

10. The tamper drive of claim 7, wherein the second bearing is disposed at least partially within the offset lobe.

11. The tamper drive of claim 7, wherein the reciprocating movement of the one or more tamper arms is about the second vertical axis; and wherein the first and second vertical axes are substantially parallel.

12. The tamper drive apparatus of claim 7, further comprising:

a counterweight coupled to the wobble shaft for dampening vibration of the second bearing.

13. The tamper drive apparatus of claim 7, further comprising:

a driver coupled to the wobble shaft for actuating the tamper drive apparatus.

14. A tamper drive, comprising:

an arm;

a vertically extending shaft fixedly coupled to one end of the arm, the shaft rotatable about a vertical axis;

one or more tamper arms fixedly coupled to a lower end of the shaft;

first and second laterally opposed cam followers disposed at the other end of the arm; and a rotatable cam providing a cam surface for each of the first and second cam followers;

wherein rotation of the cam causes a reciprocal rotation of the arm and a reciprocal rotation of the shaft about the vertical axis.

15. The tamper drive of claim 14, wherein the rotatable cam comprises a rotatable driving arm including a barrel cam disposed thereon, the barrel cam including laterally opposed cam surfaces providing the cam surface for each of the first and second cam followers.

16. The tamper drive of claim 15, wherein the first and second cam followers are disposed on an upper surface of the arm.

17. The tamper drive of claim 15, wherein the driving arm is rotatable about a horizontal axis.

18. The tamper drive of claim 15, wherein the barrel cam has a varying thickness about its periphery.

19. The tamper drive of claim 14, wherein the rotatable cam comprises a globoidal cam driver having laterally opposed cam surfaces providing the cam surface for each of the first and second cam followers;

wherein the first and second cam followers are positioned horizontally with respect to the arm.

20. The tamper drive of claim 14, further comprising:

a driver coupled to the rotatable cam for actuating the tamper drive.

* * * * *